US011017644B2

(12) United States Patent
Chen

(10) Patent No.: US 11,017,644 B2
(45) Date of Patent: May 25, 2021

(54) WARNING SYSTEM, MONITOR DEVICE AND WARNING DEVICE FOR MERCHANDISE SECURITY

(71) Applicant: Hangzhou Langhong Technology Co., Ltd, Zhejiang (CN)

(72) Inventor: Binfeng Chen, Zhejiang (CN)

(73) Assignee: Hangzhou Langhong Technology Co., Ltd, Hangzhou (CN)

( * ) Notice: Subject to any disclaimer, the term of this patent is extended or adjusted under 35 U.S.C. 154(b) by 0 days.

(21) Appl. No.: 16/697,390

(22) Filed: Nov. 27, 2019

(65) Prior Publication Data

US 2020/0168060 A1 May 28, 2020

(30) Foreign Application Priority Data

| | | |
|---|---|---|
| Nov. 27, 2018 | (CN) | 201811426870.X |
| Nov. 27, 2018 | (CN) | 201811426894.5 |
| Nov. 27, 2018 | (CN) | 201811428516.0 |
| Nov. 27, 2018 | (CN) | 201811428522.6 |
| Nov. 27, 2018 | (CN) | 201811428523.0 |
| Nov. 27, 2018 | (CN) | 201811428525.X |
| Nov. 27, 2018 | (CN) | 201811428562.0 |
| Nov. 27, 2018 | (CN) | 201811430497.5 |

(51) Int. Cl.

| | |
|---|---|
| ***G08B 13/14*** | (2006.01) |
| ***G08B 13/00*** | (2006.01) |
| ***A47F 7/024*** | (2006.01) |
| ***E05B 73/00*** | (2006.01) |
| ***G08B 13/24*** | (2006.01) |

(52) U.S. Cl.

CPC ..... *G08B 13/00* (2013.01); *A47F 7/024* (2013.01); *E05B 73/0017* (2013.01); *G08B 13/149* (2013.01); *G08B 13/1445* (2013.01); *G08B 13/2434* (2013.01)

(58) Field of Classification Search

None

See application file for complete search history.

(56) References Cited

U.S. PATENT DOCUMENTS

| | | | | |
|---|---|---|---|---|
| 8,325,036 | B1 * | 12/2012 | Fuhr | G06Q 10/087 340/5.92 |
| 2006/0097875 | A1 * | 5/2006 | Ott | G08B 13/1427 340/572.1 |
| 2009/0051535 | A1 * | 2/2009 | Brenner | G09F 27/00 340/572.1 |
| 2013/0225127 | A1 * | 8/2013 | Cavacuiti | G08B 13/1427 455/411 |
| 2014/0062698 | A1 * | 3/2014 | Fawcett | G08B 13/1463 340/568.3 |
| 2017/0351888 | A1 * | 12/2017 | Zhang | G08B 13/22 |

* cited by examiner

*Primary Examiner* — Brent Swarthout

(57) ABSTRACT

The prevent invention provides a warning system for merchandise security, comprising, a monitor device, a warning device and a controller, this warning system can control the warning device and the monitor device through the controller. This controller can work as a un-locker, especially when the warning device and the monitor device sending warning signal, and through which the system can realize message interaction, message transmission and control, the monitor device and the warning device have their own working rules.

14 Claims, 17 Drawing Sheets

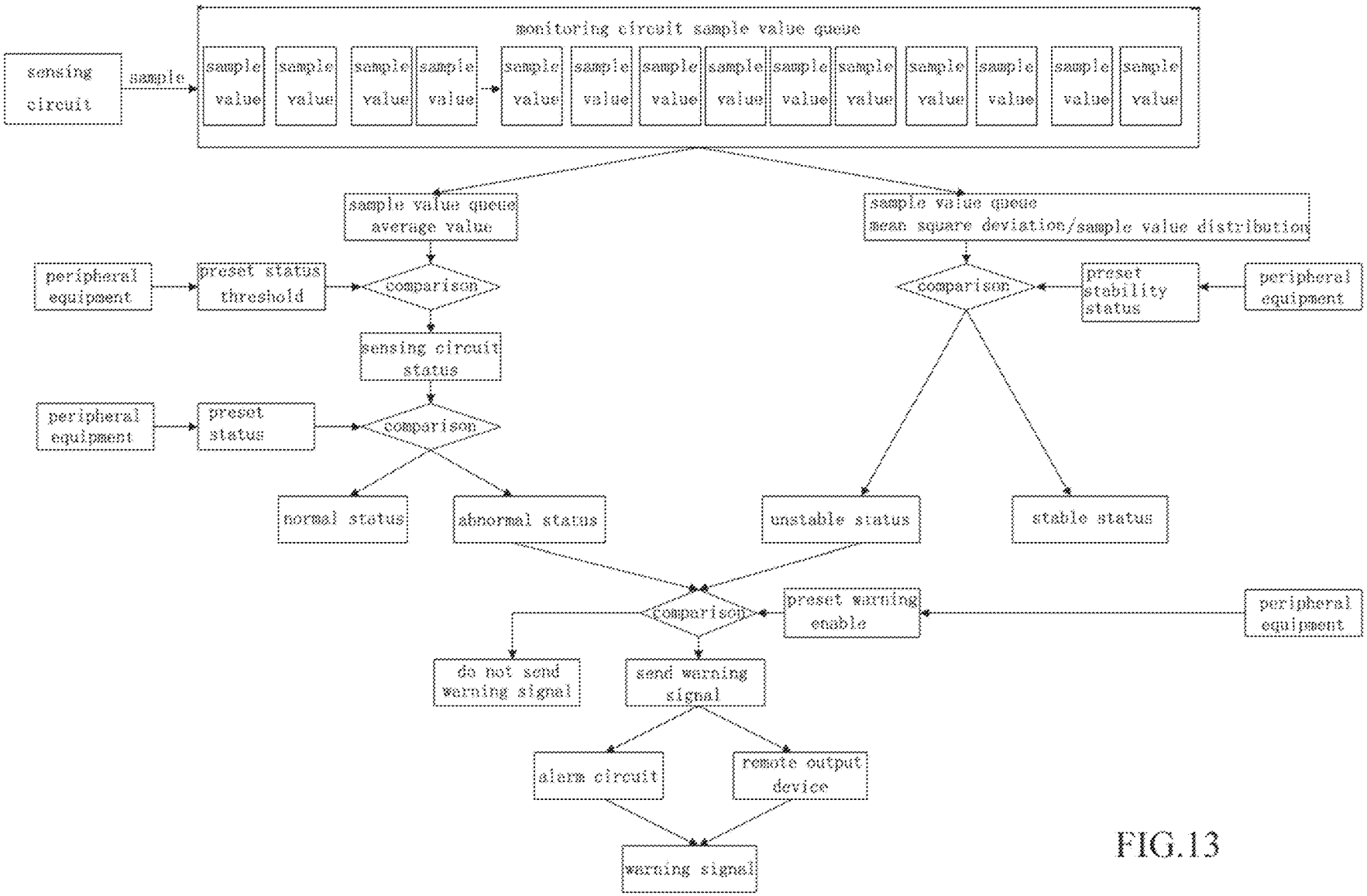
sensing circuit
sample
monitoring circuit sample value queue
sample value
sample value
sample value

| Warning Signal Packet format | | | | | |
|---|---|---|---|---|---|
| Name | Preamble | Address | Packet control | Payload | Check |
| Length | 1 byte | 5 byte | 1 byte | 0~32 byte | 1 byte |

FIG.14

| Warning Signal Payload format | | | | |
|---|---|---|---|---|
| Name | Source Device code | Command | Signal Priority | Signal Code |
| Length | 2 byte | 1 byte | 1 byte | 1 byte |

FIG.15

| Warnig signal priority, Signal Code, Warning enable list | | | | |
|---|---|---|---|---|
| Signal Priority | Priority summary | Signal code | Signal code summary | Warning enable |
| 0x10 | merchandise abnormal | 0x10 | merchandise connection break | enable |
| | | 0x20 | merchandise charging break | enable |
| 0x20 | merchandise normal | 0x10 | merchandise connect | enable |
| | | 0x20 | merchandise charging | enable |
| 0x30 | equipment abnormal | 0x10 | adapter unaccess | enable |
| | | 0x20 | adapter unstable | enable |
| | | 0x30 | adapter voltage lower | enable |
| 0x40 | equipment normal | 0x10 | adapter access | unable |
| | | 0x20 | base in place | unable |

FIG.16

| Packet format | | | | | |
|---|---|---|---|---|---|
| Name | Preamble | Address | Packet control | Payload | Check |
| Length | 1 byte | 5 byte | 1 byte | 0~32 byte | 1 byte |

FIG.17

| Payload format | | | | | |
|---|---|---|---|---|---|
| Name | Source Device code | preset order | preset class | preset subclass | preset value |
| Length | 2 byte | 1 byte | 1 byte | 1 byte | 0~4 byte |

FIG.18

| Preset class/subclass data format | | | | | |
|---|---|---|---|---|---|
| preset class | preset class sum | preset subclass | preset subclass sum | preset value | perset value sum |
| 0x01 | preset status threshold | 0x01 | shake sensing threshold | preset threshold | |
| | | 0x02 | move sensing threshold | preset threshold | |
| | | 0x03 | magnetic field sensing threshold | preset threshold | |
| | | 0x04 | pressure sensing threshold | preset threshold | |
| | | 0x05 | connecting sensing threshold | preset threshold | |
| | | 0x06 | current sensing threshold | preset threshold | |
| | | 0x07 | voltage sensing threshold | preset threshold | |
| | | 0x08 | light sensing threshold | preset threshold | |
| | | 0x09 | infrared sensing threshold | preset threshold | |
| | | 0x0a | temperature sensing threshold | preset threshold | |
| 0x02 | preset status | 0x01 | merchandise connecting status | 0x01 | connect |
| | | | | 0x02 | break or unstable |
| | | 0x02 | merchandise charging status | 0x01 | connect |
| | | | | 0x02 | break or unstable |
| | | 0x03 | adapter status | 0x01 | access |
| | | | | 0x02 | break or unstable |
| 0x03 | preset stablilty status | 0x01 | current sensing threshold | preset threshold | |
| | | 0x02 | voltage sensing threshold | preset threshold | |
| 0x04 | preset warning enable | 0x01 | enable warning signal | NA | |
| | | 0x02 | unable warning signal | NA | |

FIG.19

WARNING SYSTEM, MONITOR DEVICE AND WARNING DEVICE FOR MERCHANDISE SECURITY

CROSS REFERENCE TO RELATED APPLICATIONS

The present application claims the benefit of Chinese Patent Application Nos. 201811430497.5, 201811428562.0, 201811426894.5, 201811428525.X, 201811428522.6, 201811428523.0, 201811428516.0 and 201811426870.X filed on Nov. 27, 2018. All the above are hereby incorporated by reference.

TECHNICAL FIELD

The present invention relates to the field of merchandise anti-theft, in particular to a warning system dedicated to the field of the merchandise anti-theft.

TECHNICAL BACKGROUND

With the development of the experiential service of a merchandise, the display and experience functions of the merchandise are more open to a buyer or a potential buyer, meanwhile, the demand for the merchandise anti-theft will continue to increase. on one hand, the various needs of an experiencer are met as much as possible, the experiencer is shown with all the functions and the most convenient side of a merchandise as much as possible, and on the other hand, the possible theft by a person with a bad intention is on guard and a hidden danger of the possible theft that can exist in the process of display and experience is reduced as much as possible and even eliminated.

At present, in the field of merchandise anti-theft, a common anti-theft method is to equip each merchandise with one merchandise display device which the merchandise is fixedly connected to or operably mounted on, for example, a user can inseparably connect a part of the certain merchandise display device to the merchandise as needed, however, in order to realize the functions of experiencing and displaying the merchandise, this part of the merchandise display device can be picked up or put down during the experience of the merchandise while other parts of the merchandise display device can become anti-theft alarm devices, for example, it shall be ensured that this part of the merchandise display device connected to the merchandise and the other parts thereof (such as the alarm device) are always kept undamaged, for example, the merchandise display device is a connector that is connected to the other parts thereof through a cable, and it is necessary to ensure that the cable and the alarm device are always connected, if the connection between the cable and the alarm device is destroyed, the alarm device can be triggered to give an alarm. In this mode, once the alarm condition is released, for example, it can be a misoperation or the alarm phenomenon can be processed in time, the alarm needs to be stopped, in the prior art, a method of stopping the alarm is usually to equip an unlocker by which the alarm device is turned off, for example, the unlocker can be a device having a function similar to a key, and is turned off by the key when the alarm needs to be stopped.

An anti-theft system in the prior art usually has an alarm, the unlocker and an anti-theft device, wherein the anti-theft device can be a part carrying the merchandise or the merchandise display device, or the anti-theft device itself comprises the merchandise display device or is a part of the merchandise display device, in some cases, the anti-theft device can comprises the alarm and is then itself capable of alarming, at present, these methods all have the functions of anti-theft, alarming and unlocking, and the unlocking is as described above to turn off the alarm device or stop the alarming, these three functions are usually implemented by the controller's operation on the anti-theft device and the alarm device, the premise of this operation is that the controller and the anti-theft device often have a unique and non-replaceable corresponding relationship with the alarm device in the prior art to ensure security in a set of anti-theft systems, which is undoubtedly the best in terms of security performance, however, this method has a very poor extensibility, an electronic merchandise usually has a high display demand currently on the market but is characterized by a fast replacement along with the replacement of the anti-theft device and anti-theft device, and sometimes even along with the replacement of the anti-theft system, the cost is very high. Moreover, the system in the prior art usually uses a writing key which is written to the device (such as the unlocker and the corresponding anti-theft device comprising the alarm and the anti-theft device) to be used via a one-off operation before being put into use, and cannot be modified after writing, which causes the entire system to be replaced if one of the anti-theft devices needs to be replaced.

Moreover, the anti-theft system in the prior art has a simple and direct anti-theft function, and can alarm the sales manager in a sales place, once an unauthorized accident occurs or the merchandise can be in an unsafe state, that the merchandise can be at risk of being stolen, however, considering the security, the principle of setting such the unauthorized accident or determining that the merchandise can be in an unsafe state is generally very strict and detailed, therefore, the possibility of false alarm is very high, which often causes management personnel troubles, and sometimes cause fatigue of the alarm, resulting in being unconducive to effective management.

SUMMARY

The technical problem to be solved by the present invention is to provide a warning system, a monitor device and a warning device for merchandise security to overcome the problems in the prior art, wherein the warning system can completely comprising and replacing the anti-theft functions of the anti-theft system in the prior art, a matching method adopted by the present invention can be configured and recognized by other devices in the warning system needed to be controlled by a controller, and the controller itself can also be set through a terminal device, which makes the whole system have good extensibility, meanwhile, the warning system ensures the uniqueness and security of the system through specific equipment and a specific identification method. Moreover, the warning system can also collect the state of the merchandise protected by the system and a device the related to the merchandise in the system, and reflect some conditions of these devices by the state including whether the merchandise is in an unsafe state, thereby effectively determining the conditions of the entire warning system and being capable of outputting a signal that can more accurately, meticulously and timely feedback the merchandise in a display state or the state of sales and the various states of the anti-theft system arranged for the security of these merchandise, we generalize this function of the warning system as monitoring. A device with this function can be called a monitor device, similarly, the monitor device can also be recognized, configured and controlled by the controller in the system, which can more effectively achieve anti-theft performance while maintaining the anti-theft system itself.

To this end, the present invention adopts the following technical solutions:

The present invention first provides a warning system for merchandise security, comprising a monitor device, a warning device and a controller;

The monitor device can be directly or indirectly connected to a merchandise and/or a merchandise display device, and is configured to be capable of monitoring the connection state of the merchandise and/or merchandise display device and to issue a warning signal when the connection state is in an abnormal state and/or an unstable state.

The warning device is configured to be capable of receiving the warning signal issued by the monitor device and outputting the warning signal through an output device.

The controller comprises an identifiable communication interface and is configured to be capable of releasing the warning signal of the monitor device and the warning device through the communication interface.

Further, the monitor device comprises an induction circuit, and is configured to enable the merchandise and/or the merchandise display device to be sampled, or to be capable of sensing the state of the merchandise and/or merchandise display device.

The induction circuit is configured to be capable of feeding back a sampling result to the monitoring circuit.

Further, the monitor device comprises an alarm circuit, and is configured to receive the warning signal of the monitoring circuit and transmit the warning signal to the warning device.

Further, the warning device comprises a signal processing circuit, and is configured to be capable of receiving and processing the warning signal of the monitoring circuit and outputting the processed signal through the output device.

The warning signal comprises the warning signal for warning the abnormal state and the warning signal for warning the unstable state.

Further, the controller is configured to be capable of initializing the monitor device and the warning device through the identifiable communication interface or other communication interface comprised therein.

Further, the controller configures a preset state and a preset value of the monitor device and the warning device by initialization.

Further, the initialization comprises initialization of a controlling relationship; the initialization of a controlling relationship indicates that the initialized monitor device and/or the warning device are capable of identifying and executing a control signal issued by the controller.

Further, the initialization comprises initialization of a warning relationship; the initialization of a warning relationship indicates that the initialized warning device is capable of identifying and executing the warning signal issued by the initialized monitor device.

Further, the initialization further comprises the initialization of a warning mode.

Further, the initialization of the warning mode comprises a preset warning signal priority, and the warning device configured by the preset mode is capable of sequentially outputting the warning signal according to the preset warning signal priority.

Further, the initialization of the warning mode comprises a preset warning signal output function, and the warning device configured by the preset mode is capable of selectively outputting different types of warning signals according to the preset signal output function.

In addition to the above system, the present invention can still provide a monitor device for merchandise security. The monitor device can be applied to the above warning system or can be independent of the above warning system, however, preferably, the monitor device can be applied to the above warning system and comprises a monitoring circuit and an induction circuit.

The induction circuit is directly or indirectly connected to a merchandise and/or a merchandise display device, and is configured to be capable of sensing the state of the merchandise and/or the merchandise display device.

The monitoring circuit is directly or indirectly connected to the induction circuit, and is configured to be capable of monitoring an induction state of the induction circuit.

The monitor device is configured to issue a warning signal when the induction state is in an abnormal state and/or an unstable state.

Further, the monitoring circuit comprises a micro control unit, and is configured to be capable of sampling the signal of the induction circuit and obtaining the state of the induction circuit through calculation.

Further, the induction circuit comprises an induction element and/or an induction loop.

Further, the monitor device comprises an output device, the output device is directly or indirectly connected to the monitoring circuit, and is configured to be capable of being controlled by the monitoring circuit and outputting part or all of the warning signals.

Further, the warning signal comprises a digital signal usable for transmission, the digital signal is configured to be received and processed by a warning device.

Further, the monitor device is configured to be capable of being preset by the controller.

In addition, the present invention can still provide a warning device for merchandise security. As an integral part of a merchandise security system, the warning device itself can also be used alone, but preferably, the warning system can be applied to the warning device to achieve the best matching state.

The warning device is configured to be capable of being initialized by a controller, and the initialized warning device can receive a warning signal issued by the monitor device and output the warning signal through an output device, and can release the warning signal of the monitor device through the controller.

Further, the warning signal comprises an visual signal and/or an audible signal and/or a haptic signal.

Further, the warning signal comprises an alarm signal and/or an alerting signal and/or a prompt signal.

The following content is also a part or the whole of the technical solutions of the present invention, which disclose the technical solutions claimed by the present invention as well as some details and extensions.

In a first aspect of the present invention, the present invention provides a warning system for merchandise security, comprising a monitor device, a warning device and a controller; wherein the monitor device can monitor and control a merchandise or a merchandise display device, and issue a warning signal when it is appropriate, in general, the warning signal can be received by the warning device, and the warning device performs a corresponding warning operation according to the warning signal, for example, issuing an alerting signal, an alarm signal, or a prompt signal, which can all be comprised in the scope of the warning signal. The controller can control the monitor device and the warning device, but first needs to initialize the monitor device and the warning device.

The controller comprises a communication interface, and is configured to initialize the monitor device and the warning device through the communication interface, which is a configuration to the monitor device and the warning device by the controller, therefore, the originally blank monitor device and warning device can be initialized and recognized by the controller, can receive and execute a control instruction issued by the controller, and in some cases, the monitor device and the warning device can also feedback the state thereof or the signals collected, sensed and issued to the controller, enabling interaction within the system.

The monitor device comprises a monitoring circuit and is configured to be directly or indirectly connected to the merchandise and/or the merchandise display device and be capable of monitoring the connection state of the merchandise and/or the merchandise display device, and issuing the warning signal when the connection state is an abnormal state and/or an unstable state.

In some preferred embodiments, the monitor device itself can be an entity; in some preferred embodiments, the monitor device can be fixed to the merchandise, or the merchandise display device; in some preferred embodiments, the monitor device comprises the merchandise display device.

In some preferred embodiments, the monitor device can be connected to a cable and transmit the signal through the cable. In some preferred embodiments, the monitor device can also transmit the signal through wireless communication.

The warning device is configured to be capable of receiving the warning signal of the monitor device and outputting the warning signal through the output device. In some preferred embodiments, the warning device can comprise an output device, in some preferred embodiments, the warning device can be externally connected to the output device, and in some preferred embodiments, the warning signal comprises a security signal. In some preferred embodiments, the warning signal comprises a prompt signal.

Further, the communication interface is an identifiable communication interface, and comprises a wired communication interface and/or a wireless communication interface.

Further, the initialization is performed by wired or wireless manner. In some preferred embodiments, if the initialized communication interface is wired, the initialization can be implemented by the wired mode. In some preferred embodiments, if the initialized communication interface is wireless, the initialization can be implemented by the wireless manner.

Further, the controller configures a preset state and a preset value of the warning device and the monitor device by the initialization. In some preferred embodiments, the initialization is not only a process of matching and recognizing, but also can preset some initial states or preset states (a default state) of the warning device and the monitor device within a certain degree or a certain range, to be capable of playing a role in later work. For example, a certain state of the monitor device can be preset, if no matching with the preset state, the monitor device can issue the warning signal, or the warning device can be preset to an initial value, and issue a corresponding signal or feedback the signal to the monitor device when the initial value is exceeded or insufficient.

Further, the controller can initialize the monitor device and the warning device respectively and/or simultaneously. In some preferred embodiments, the controller can initialize the monitor device separately, in some preferred embodiments, the controller can initialize the warning device separately, in some preferred embodiments, the controller can initialize the monitor device and the warning device simultaneously, in some preferred embodiments, the controller can initialize the monitor device and the warning device respectively, in some preferred embodiments, the controller can initialize the monitor device first, and then initialize the warning device, in some preferred embodiments, the controller can initialize the warning device first and then initialize the monitor device.

Further, the initialization comprises the initialization of a controlling relationship, that is, the initialized monitor device and/or warning device can identify the control signal issued by the controller, so that the initialized monitor device and/or warning device can be controlled by the controller. In some preferred embodiments, the controller for initialization can control the monitor device and the warning device that are initialized by the controller, and other controllers without initialization cannot control the monitor device and the warning device, and the controller cannot control the monitor device or warning that are not initialized by the controller.

Further, the initialization comprises the initialization of a warning relationship, that is, the initialized warning device can identify the warning signal issued by the initialized monitor device.

Further, the initialization further comprises the initialization of a warning mode, in some preferred embodiments, the initialization of the warning mode can comprise the selection of a type of the warning signal, in some preferred embodiments, the initialization of the warning mode can comprise the selection of a preset mode of the warning device.

Further, the monitor device and the warning device are configured to be initialized by connecting an intelligent terminal through a controller, in some preferred embodiments, the warning system of the present invention can be connected to the intelligent terminal, a user can directly operate on the intelligent terminal, and the operation is transmitted to the controller by means of a wireless signal, and is set by the controller.

Further, the controller comprises a configurable communication interface and is configured to be capable of be connected to by the configurable communication interface and be configured by the intelligent terminal.

In this case, the three main components in the warning system, that is, the controller, the monitor device and the warning device can be connected through the initialization, since both of the warning device and the monitor device need to be controlled by the controller in use, an effective and secure communication relationship in the system can be established by initializing the warning device and the monitor device by the controller to establish an internal connection therebetween and a unique, exclusive, effective and secure communication relationship, since this initialization can be continuously repeated and reproduced, once any device in the system changes or needs to be reconfigured, a new system can be configured by reinitialization, no hardware change are required, and the key does not need to be rewritten, making the system both be secure and have extensibility.

In a second aspect of the present invention, the present invention provides a warning system for merchandise security, comprising a monitor device, a warning device and a controller; wherein the warning system can control the warning device and the monitor device through the controller, which particularly unlocks the controller when the warning device and the monitor device issue a warning signal.

The monitor device can comprise a monitoring circuit, is directly or indirectly connected to a merchandise and/or a merchandise display device, and is configured to be capable of monitoring the connection state of the merchandise and/or merchandise display device, and issuing the warning signal when the connection state is an abnormal state and/or an unstable state.

In some preferred embodiments, the monitor device itself can be an entity; in some preferred embodiments, the monitor device can be fixed to the merchandise, or the merchandise display device; in some preferred embodiments, the monitor device comprises the merchandise display device.

In some preferred embodiments, the monitor device can be connected to the cable and transmit the signal through the cable, in some preferred embodiments, the monitor device can also transmit the signal by the wireless communication.

The warning device is configured to be capable of receiving the warning signal issued by the monitor device and outputting the warning signal through the output device; in some preferred embodiments, the warning device can comprise the output device, in some preferred embodiments, the warning device can be externally connected to the output device, and in some preferred embodiments, the warning signal comprises a security signal. In some preferred embodiments, the warning signal comprises the prompt signal.

The controller comprises the identifiable communication interface and is configured to be capable of releasing the warning signals of the monitor device and the warning device through the identifiable communication interface. In some preferred embodiments, the controller comprises at least one identifiable communication interface through which the warning signals of the monitor device and the warning device can be released respectively, in some preferred embodiments, the controller comprises at least one identifiable communication and is configured to simultaneously release the warning signals of the monitor device and the warning device through the identifiable communication interface, in some preferred embodiments, the controller comprises the identifiable communication interface corresponding to the monitor device and the warning device, respectively, the monitor device and the warning device can be identified by different identifiable communication interfaces and be controlled by the identifiable communication interface thereof. In some preferred embodiments, the controller comprises only the identifiable communication interface corresponding to the monitor device, and is configured to control the identified monitor device through the communication interface, in some preferred embodiments, the controller comprises only the identifiable communication interface corresponding to the warning device, and is configured to control the identified warning device through the communication interface, in some preferred embodiments, the identifiable communication interface is the same as the initialized communication interface, and in some preferred embodiments, the communication interface is different from the initialized communication interface Further, the monitor device comprises the induction circuit and is configured to be capable of sampling the merchandise and/or the merchandise display device. In some preferred embodiments, the induction circuit comprises a sampling circuit; in some preferred embodiments, the induction circuit comprises a sampling circuit for the surface of the merchandise for collecting information on the surface of the merchandise, such as connection state, a touch state, a vibration state, a movement state, an experience state, etc.; in some preferred embodiments, the induction circuit comprises a sampling circuit for the merchandise display device for collecting the state of the merchandise display device, such as the sampling for a support surface; in some preferred embodiments, the induction circuit comprises a sampling circuit for a charging interface, is used to collect the connection state or the charging state of the charging interface; in some preferred embodiments, the induction circuit comprises a sampling circuit for a power adapter for collecting the state of the power adapter, such as the output voltage or the current and the power-on state of the power adapter itself; in some preferred embodiments, the induction circuit comprises a sampling circuit for sales or an display environment for collecting the sales or the display environments of the merchandise display device, such as light, an infrared signal or temperature, these factors can be used to determine whether the merchandise is in a normal state or an experienced state.

In some preferred embodiments, the sampling circuit comprises a pressure sampling circuit for collecting the pressure on a certain force surface in the system, such as a surface or a support surface of the merchandise, to determine whether the merchandise is in a state of being experienced or picked up, or to determine whether the merchandise display device is damaged or the like; in some preferred embodiments, the sampling circuit comprises a vibration sampling circuit for sensing vibration, and in some preferred embodiments, the sampling circuit comprises a movement sampling circuit for sensing a movement state; in some preferred embodiments, the movement sampling circuit can be used to sense the experience state; in some preferred embodiments, the sampling circuit comprises a connection sampling circuit that can be used to collect various connection states in the system, such as the connection state of the merchandise and the merchandise display device, or the connection state of the merchandise and the charging interface, or the connection state of the charging interface and the cable, or the connection state of the cable and the merchandise display device, etc.; in some preferred embodiments, the sampling circuit comprises a voltage sampling circuit that can be used to sample a voltage in an electrical connection in the system, such as the charging interface or the power adapter, to determine whether the electrical connection is in a normal or abnormal state or a stable or unstable state; in some preferred embodiments, the sampling circuit comprises a current sampling circuit that can be used to sample a current of the electrical connection in the system, such as the charging interface or the power adapter or the cable or the like, to determine whether the electrical connection is in the normal or abnormal or the stable or unstable state; in some preferred embodiments, the sampling circuit comprises a light intensity sampling circuit that can be used to collect light intensity in a surrounding environment; in some preferred embodiments, the sampling circuit comprises an infrared signal sampling circuit that can be used to collect a signal in the surrounding environment through an infrared signal, to determine whether the merchandise is in a sensed state, or whether the merchandise or the merchandise collection device can be in a certain changing state. In some preferred embodiments, the sampling circuit comprises a temperature sampling circuit that can be used to collect the temperature in the surrounding environment, to determine whether the surrounding environment is in the abnormal state, or can sense human traffic involving merchandise experience or display and other information in the surrounding environment through a changing temperature.

Further, the induction circuit is configured to be capable of feeding back the sampling result to the monitoring circuit. In some preferred embodiments, the induction circuit itself cannot determine whether the sampling result is good or bad. After the induction circuit completes a sampling task, the sampling result is transmitted to the monitoring circuit, and the sampling circuit analyzes and determines the sampling result of the induction circuit, to further obtain the state of the merchandise and/or the merchandise display device.

Further, the monitor device comprises an alarm circuit and is configured to receive the warning signal of the monitoring circuit and transmit the signal to the warning device. In some preferred embodiments, the alarm circuit acts as one portion of the monitor device and functions as outputting the warning signal outward; in some preferred embodiments, the alarm circuit transmits the warning signal to the warning device, in some preferred embodiments, the warning circuit transmits the warning signal outwards in a wired manner, in some preferred embodiments, the alarm circuit transmits the warning signal in a wireless manner, in some preferred embodiments, the warning circuit transmits the warning signal to other anti-theft devices or the output device.

Further, the warning signal comprises the warning signal for warning the abnormal state and the warning signal for warning the unstable state. In some preferred embodiments, the warning signal is used to indicate a state that should not occur, that is, other states in which the entire warning system is not in a normal operation, for example, a component in the warning system is faulty, and can not work properly, or has possible theft, these can be prompted by the warning signal. In some preferred embodiments, the warning signal can be used to warn an abnormal state, for example, the cable is broken, causing the electrical connection to be interrupted, which can be considered as the abnormal state, or the merchandise and the charging interface are disconnected, and the merchandise can be considered in the risk of being stolen, these can then be considered to be in the abnormal state; in some preferred embodiments, the warning signal can be used to warn the unstable state, for example, the voltage of the adapter is unstable, or the current on the cable is in the unstable state, when these unstable situations occur, it necessarily indicates that there are some problems in the system, that is, even if there is no problem at present, there are also hidden dangers in the system, which shall be discovered and eliminated in time to avoid the actual impact on the function of the system; in some preferred embodiments, the warning system can also issue a prompt signal to some information that needs to be prompted, for example, after being displayed, the merchandise is not put back in time.

Further, the warning device comprises a signal processing circuit and is configured to receive and process the warning signal of the monitoring circuit and output the processed signal through the output device.

Further, the monitor device is configured to be configurable by the intelligent terminal. In some preferred embodiments, the monitor device can be connected the intelligent terminal in the wireless manner, and can set the initial state thereof through the intelligent terminal, in some preferred embodiments, the setting can be performed simultaneously with the controller or separately.

Further, the monitor device is configured to be configurable by connecting the intelligent terminal through a controller. In some preferred embodiments, the intelligent terminal is connected to the controller and the monitor device, and can configure the monitor device through the controller; in some preferred embodiments, the intelligent terminal can configure the controller, and then configure the monitor device through the controller.

Further, the connection state comprises a connection state of the merchandise and the monitoring circuit, and/or a connection state of the merchandise display device and the monitor device. In some preferred embodiments, the connection state indicates that the merchandise and/or the merchandise display device are in a normal state, that is, a generally considered safe state, and thus monitoring the connection state is an important indicator of whether the displayed merchandise is safe.

In this case, the controller realizes matching with the warning device and the monitor device through the initialization, and the matching can be reproduced, but is unique to the system before being authorized for reconfiguration, that is to say, a communication mode and a communication protocol of the controller and the monitor device as well as the warning device are set, which is safe for the system. After an effective and secure system is established, the controller communicates with the warning device and the monitor device through the identifiable communication interface, thereby realizing information interaction as well as signal transmission and control. The control mainly refers to that the controller releases the warning signal of the warning device and the monitor device, but for the monitor device and the warning device itself, each has the own working rules, for example, the monitor device monitors the security in the entire warning system through the internal induction circuit and the monitoring circuit therein, and issue to and prompt the staff the detected unstable state or abnormal state by the warning device.

In a third aspect of the present invention, the present invention provides a warning system for merchandise security, the warning system comprises a monitor device and a warning device, The monitor device is directly or indirectly connected to a merchandise and/or a merchandise display device, and is configured to monitor a connection state of the merchandise and/or merchandise display device, and to issue a warning signal when the connection state is in an abnormal state and/or an unstable state;

The warning device comprises a communication interface and is configured to be capable of receiving the warning signal issued by the monitor device;

The warning device comprises an output device and is configured to be capable of outputting the warning signal through a preset mode.

Further, the communication interface is a wireless communication interface, in some preferred embodiments, the warning device can receive the warning signal issued by a controller through a wireless communication.

Further, the communication interface is an identifiable communication interface and is configured to be capable of identifying the warning signal of the monitor device, and in some preferred embodiments, the identifiable communication interface is configured to be capable of receiving a signal of other devices and identifying the signal, thereby enabling the warning device to receive and execute the instruction of the signal, Further, the output device comprises an optical output device and/or an audible output device. In some preferred embodiments, the output device comprises the optical output device, such as a display screen or an indicator light; in some preferred embodiments, the output device comprises the audible output device, such as a buzzer or a sound box; in some preferred embodiments, the output device comprises the optical output device and the audible output device.

Further, the warning signal comprises an alarm signal and/or an alerting signal and/or a prompt signal. In some preferred embodiments, the warning signal can be the alarm signal, which can be used to directly indicate that the merchandise is in an unsafe state; in some preferred embodiments, the warning signal can be a warning signal, which can be used to indirectly indicate that the merchandise is the unsafe state; in some preferred embodiments, the warning signal can be the prompt signal, and can be used to remind that certain devices in the system are or can be in an abnormal state, for example, the merchandise is not placed back in place after the experiencing thereof, or the voltage or current in the cable or a charging interface can be in the unstable state, and so on.

Further, the preset mode comprises a preset warning signal priority, and is configured that the warning device can preferentially output the warning signal and/or the alerting signal and/or the prompt signal according to the preset warning signal priority. In some preferred embodiments, the warning device can be preset; in some preferred embodiments, as previously described, the warning device can be preset by the initialization; in some preferred embodiments, the warning device can be preset by the controller or the monitor device. In some preferred embodiments, the preset indicates that certain initial or default values or initial or default states can be set in the warning device; in some preferred embodiments, the warning device can be set with the preset state, for example, the manner in which the warning signal can be output; in some preferred embodiments, the warning device can be preset with a warning signal priority, so that the warning device can issue the signal according to the priority, for example, three priorities are preset, when the warning device receives a plurality of warning signals within the same time period, the warning device transmits a sequence according to the arrangement of the priority, and outputs/issues the warning signals according to this sequence other than the sequence of receiving the warning signal.

Further, the preset mode comprises a preset warning signal output function, and is configured that the waring device can selectively output the alarm signal and/or the alerting signal and/or the prompt signal according to a preset signal output function. In some preferred embodiments, the warning device can preset to an output mode or the output function, and for example, can selectively shield or do not issue certain signals, or can selectively issue the certain signals, such a function can be realized by presetting the function that can output the signal, for example, in some scenarios, only the alarm signal can be preset to be issued, or in some scenarios, only the alerting signal can be preset to be issued, or in some scenarios, only the prompt signal can be preset to be issued, or two of three signals are performed, and so on.

Further, the preset mode is configured to enable the warning device to be directly or indirectly connected to an intelligent terminal for preset. In some preferred embodiments, the warning device can be directly connected to the intelligent terminal, and the above state and function are preset by the intelligent terminal, in some preferred embodiments, the warning device can be indirectly connected to the intelligent terminal, for example, through some intermediate components, but can still be preset by the intelligent terminal.

Further, the preset mode is configured to enable the warning device to be preset by connecting the intelligent terminal through an interactive controller. In some preferred embodiments, the interactive controller can be used as a bridge component for connecting the warning device and the terminal device, the terminal device is connected to the interactive controller, and the interactive controller can realize information interaction, meanwhile, the interactive controller can be connected to the warning device, and also interacts with the warning device and can control the warning device, so that the configuration operation on the terminal device can be performed on the warning device through the interactive controller.

In this case, the warning device can be preset to adjust the warning mode of the warning device and the sequence of the warning device to transmit the warning signal, the application scenario and performance of the warning device are expanded, so that the application of the warning device can be more user-friendly.

In a fourth aspect of the present invention, the present invention provides an interactive warning system for merchandise security, the interactive warning system comprises an interactive monitor device in which the monitor device can be interactive with an intelligent terminal through an interactive controller. The interactive warning system comprises an interactive controller and a monitor device; in the interactive warning system, the controller and the monitor device can be connected to the intelligent terminal, or can further be connected to a cloud-connected terminal by the intelligent terminal to realize terminal interaction.

The monitor device is configured to be directly or indirectly connected to a merchandise and/or a merchandise display device to monitor the connection state of the merchandise and/or merchandise display device, and to issue a warning signal when the connection state is in an abnormal state and/or an unstable state.

The controller is an important component in the warning system that implements an interactive function, and the interactive controller comprises a first communication interface, the first communication interface is configured to be capable of communicating with the monitor device; the interactive device further comprises a second communication interface configured to be capable of communicating with the intelligent terminal.

Further, the intelligent terminal comprises a mobile phone, a tablet and a cloud-connected device, which have a communication interface, an input device and an output device. In some preferred embodiments, the intelligent terminal can be an intelligent terminal device, such as the mobile phone, the tablet, etc., through which the wireless connection with the controller can be directly established; in some preferred embodiments, the intelligent terminal can be a cloud-connected, in some preferred embodiments, the intelligent terminal can be connected to the cloud-connected and perform data interaction with the cloud-connected; in some preferred embodiments, the intelligent device has the communication interface, which can be wired or wireless, and is used to interact with the monitor device and the warning device; in some preferred embodiments, the intelligent terminal can comprise an output device that directly outputs the signal outwards or to other devices.

Further, the second communication interface is a wireless communication interface. In some preferred embodiments, the controller can communicate with the terminal device in a wireless manner.

Further, the first communication interface is the wireless communication interface or the wired communication interface. In some preferred embodiments, the controller can communicate with the monitor device in the wireless manner. In some preferred embodiments, the controller can communicate with the monitor device in a wired manner.

Further, the first communication interface is an identifiable communication interface and is configured to be capable of identifying the monitor device in the interactive warning system. In some preferred embodiments, such an identification can be realized by prior configuration or initialization, and the initialized monitor device can be identified with the controller and can controlled by the controller by the identification.

Further, the interaction comprises that the monitor device can be controlled by the intelligent terminal. In some preferred embodiments, the monitor device can interact with the intelligent terminal; in some preferred embodiments, such an interaction comprises mutual transmission of the signal; in some preferred embodiments, this interaction is realized by the communication between the intelligent terminal and the monitor device.

Further, the interaction comprises that the intelligent terminal can output the state of the monitor device, that is, when the intelligent device can implement the interaction with the monitor device, the monitor device can transmit the collected signal to the intelligent terminal, which can be displayed through sound, display, etc. of the intelligent terminal.

Further, the interactive controller can release the warning signal of the monitor device and/or the warning device.

In this case, the warning system of the present invention introduces the intelligent terminal as a way of configuring the controller and the monitor device, and the intelligent terminal can establish a connection with the controller and the monitor device in the wireless manner, this very user-friendly man-machine interaction intelligent device can easily configure and connect the controller and the monitor device, and the intelligent device can also be configured accordingly, so that the controller and the monitor device can communicate with the intelligent device, which meets the requirements of the anti-theft system, then in this case, the intelligent device can interact with the monitor device or the controller, to control the controller or the monitor device, or control the monitor device through the controller, or even acts as the output device of certain signals in the warning system.

According to a fifth aspect of the present invention, the present invention provides a presettable warning system for merchandise security, which is configured to enable a presettable controller to control a monitor device by a preset control function, the presettable warning system comprises the presettable controller and the monitor device;

The monitor device is configured to be directly or indirectly connected to a merchandise and/or a merchandise display device, and monitor the connection state of the merchandise and/or merchandise display device and issue a warning signal when the connection state is in an abnormal state And/or an unstable state.

For the controller, in the presettable warning system, the controller can be the presettable controller, the presettable controller comprises the second communication interface, the second communication interface is configured to be capable of communicating with an intelligent terminal; the presettable controller further comprises a storage device, and is configured to enable a control function stored in the storage device to be preset by the intelligent terminal; or the preset state of the controller can be stored in the storage device, thereby ensuring that the preset state of the controller can be fixed in the controller and can function when the function is realized in the system in the controller.

Further, the intelligent terminal comprises a mobile phone, a tablet, a cloud-connected device, which has a communication interface, an input device, and an output device. In some preferred embodiments, the intelligent terminal can be an intelligent terminal device, such as a mobile phone, a tablet, etc., through which a wireless connection with the controller can be directly established; in some preferred embodiments, the intelligent terminal can be a cloud-connected, in some preferred embodiments, the intelligent terminal can be connected to the cloud-connected and perform data interaction with the cloud-connected; in some preferred embodiments, the intelligent device has a communication interface, which can be wired or wireless and is used to interact with the controller, the monitor device and the warning device; in some preferred embodiments, the intelligent terminal can comprise the output device that directly outputs the signal outwards or to other devices.

Further, the second communication interface is a wireless communication interface or a wired communication interface. In some preferred embodiments, the controller communicates with the intelligent device in a wireless manner; in some preferred embodiments, the controller communicates with the intelligent device in a wired manner.

Further, the storage device comprises an external storage device or an internal storage device. In some preferred embodiments, the storage device is incorporated within the controller in an internally mounted form. In some preferred embodiments, the storage device can be external and connected directly or indirectly to the controller, in which case the storage device can preferably be in synchronized data interaction with the controller.

Further, a control function comprises releasing the warning signal and/or turning off a warning function and/or turning on the warning function. since the monitor device can issue the warning signal, and the warning signal only needs to work within a certain time or range, once the purpose of the warning signal is achieved, the warning signal needs to be turned off, or, in some scenarios, the warning function of the monitor device does not need to be turned on, or some of the warning functions need to be turned off, which can be controlled by the controller at this time.

Further, the preset comprises enabling a control function and/or disabling the control function. In some preferred embodiments, the preset to the controller can further comprise a preset for whether the controller enables the control function and whether the controller disables the control function. In some preferred embodiments, the preset to the controller can also comprise a preset for whether the controller enables the control function or whether the controller disables the control function. In some preferred embodiments, the preset to the controller can also comprise a preset for how the controller enables the control function and how the controller disables the control function. In some preferred embodiments, the preset to the controller can also comprise a preset for how the controller enables the control function or how the controller disables the control function.

Further, the preset comprises the number of use and/or the time of use of the preset controller. In some preferred embodiments, the preset to the controller can comprise a preset of the number of uses of the controller, and the preset can be an overall preset in the system, for example, times that the controller is used and then automatically fails is preset, the preset can also be a preset of a certain time period or a number of control times in a certain scene, for example, in a certain exhibition, times the controller is automatically invalidated is preset; in some preferred embodiments, the preset for the controller can comprise the preset of the usage time of the controller, this preset can be an overall preset in the system, for example, times that the controller is used and automatically fails is preset, it is prompted that the controller is replaced in time to ensure security, it also can be the preset of the control time in the certain scenario, for example, in a certain exhibition, the time period that the controller is used and automatically fails is preset, which can avoid that the controller is still valid after a single exhibition.

In this case, the controller can be configured through the intelligent terminal, and the intelligent terminal can perform an extended preset on the controller, and various functions of the controller can be configured in the intelligent terminal according to the needs of the actual use occasion, to meet the needs of different occasions, compared with the prior art, the functions that a system can implement and cover are greatly expanded, and the security of the system can be guaranteed at the same time.

According to a sixth aspect of the present invention, the present invention provides a monitor device for merchandise security, which can be used in the above warning system, and functions as monitoring the merchandise and/or the merchandise display device in the warning system, the monitor device is configured to issue a warning signal when an induction state is in an abnormal state and/or an unstable state.

The monitor device comprises a monitoring circuit and an induction circuit, the induction circuit is directly or indirectly connected to a merchandise and/or a merchandise display device, and is configured to sense the state of the merchandise and/or the merchandise display device; the monitoring circuit is directly or indirectly connected to the induction circuit, and is configured to be capable of monitoring an induction state of the induction circuit.

Further, the monitoring circuit comprises a micro control unit and is configured to be capable of sampling a signal of the induction circuit and obtaining a state of the induction circuit through calculation, as described above, the induction circuit is configured to sense various states, but the induction circuit functions as a sensor in many cases, which does not perform logical operation and comparison, therefore, the induction circuit can transmit the sensed state or the collected data to the monitoring circuit in the monitor device, and the monitoring circuit compare and calculate the state or the data to get the monitoring result, which can determine whether the monitor device issues the warning signal.

Further, the induction circuit comprises an induction element or an induction loop. In some preferred embodiments, the induction element is attached directly or indirectly to the merchandise; in some preferred embodiments, the induction element is connected directly or indirectly to the merchandise; in some preferred embodiments, the induction element is directly or indirectly attached to the merchandise display device; in some preferred embodiments, the induction element is attached directly or indirectly to the merchandise display device; in some preferred embodiments, the induction loop is attached directly or indirectly to the merchandise; in some preferred embodiments, the induction loop is directly or indirectly connected to the merchandise; in some preferred embodiments, the induction loop is directly or indirectly connected to the merchandise display device; in some preferred embodiments, the induction loop is attached directly or indirectly to the merchandise display device.

Further, for the features whether the abnormal state is normal or different from the normal state, in some preferred embodiments, the abnormal state refers to a state that can be reflected when a fault occurs; in some preferred embodiments, the state different from the normal state refers to a state different from a normal work, this state does not necessarily indicate a possible failure, but rather indicates that it can be different.

Further, the unstable states are relative. In some preferred embodiments, the unstable state is relative to a stable state, when the state is different from the stable state, it can be considered as an unstable state; in some preferred embodiments, the unstable state comprises an unstable state in a general sense, for example, an instability due to a malfunction or an abnormal condition.

Further, the warning signal comprises an visual signal and/or an audible signal, in some preferred embodiments, the visual signal can comprise an optical signal and a display signal, in some preferred embodiments, the audible signal can comprise a sound signal.

Further, an output device is comprised, is directly or indirectly connected to the monitoring circuit, and is configured to be controllable by the monitoring circuit and to output the visual signal and/or the audible signal.

Further, the warning signal comprises a digital signal that is usable for transmission, the digital signal is configured to be capable of being received and processed by the warning device.

Further, a communication interface is comprised and is configured to be capable of transmitting the digital signal.

In this case, the monitor device can not only monitor whether the merchandise is in a safe state, but also monitor whether the various devices in the system are in a normal work state, once the normal work state is destroyed or the balance is broken, even if there is no set anti-theft status, for example, the merchandise can be in a state of being stolen, the monitor device can also monitor and feedback the operation of the system itself, such as issue an alarm signal, etc., and can prompt the work state of the system in time, facilitating the maintenance of the system, which can effectively prevent loopholes that cannot be detected due to the failure of the system itself but cannot be discovered by the staff.

According to a seventh aspect of the present invention, the present invention provides a presettable monitor device for merchandise security, which can be directly or indirectly connected to a merchandise and/or merchandise display device and is configured to be capable of monitoring the connection state of the merchandise and/or the merchandise display device, a warning signal is issued when the connection state is in an abnormal state and/or an unstable state; the monitor device comprises a first communication interface which is configured to directly or indirectly communicate with an intelligent terminal, the monitor device further comprises a storage device which is configured to be capable of being used to store a preset value and/or a function, the preset value and/or function stored in the storage device are preset by the intelligent terminal.

In some preferred embodiments, the connection state refers to the connection state of the merchandise and the merchandise display device, if the connection state of the merchandise and the merchandise display device is destroyed, the merchandise is likely to be at risk of being stolen; in some preferred embodiments, the connection state refers to the connection state of the merchandise and the monitor device, and the connection between the monitor device and the merchandise can be to ensure the security of the merchandise, and if the connection state of the merchandise and the monitor device is destroyed, the merchandise is likely to be at risk of being stolen; in some preferred embodiments, the connection state refers to the connection state of the merchandise display device and the monitor device, in some cases, the anti-theft state of the merchandise is detected by the connection between the merchandise display device and the monitor device, and if the connection state of the merchandise display device and the monitor device is destroyed, the merchandise is likely to be at risk of being stolen.

Further, the intelligent terminal comprises a mobile phone, a tablet and a cloud-connected device, which have a communication interface, an input device, and an output device.

Further, the first communication interface is a wireless communication interface, and the wireless communication interface enables the connection between the intelligent terminal and the monitor device and the position of the monitor device to be more flexible and convenient to operate.

Further, the first communication interface is an identifiable communication interface and is configured to be identified by an interactive controller. In some preferred embodiments, the interactive controller is a device within another system than the monitor device; in some preferred embodiments, the monitor device can communicate with the interactive controller to realize interaction; in some preferred embodiments, the monitor device can be controlled by the interactive controller; in some preferred embodiments, the monitor device can exchange information with the interactive controller; in some preferred embodiments, the monitor device can be configured by the interactive controller.

Further, the presettable monitor device can communicate with the intelligent terminal through the interactive controller. In some preferred embodiments, the interactive controller can establish a connection with the monitor device and the intelligent terminal, respectively; in some preferred embodiments, the preset monitor device can be configured by the intelligent terminal through the interactive controller.

Further, the storage device comprises an external storage device or an internal storage device. In some preferred embodiments, the storage device is arranged within the monitor device; in some preferred embodiments, the storage device is arranged external to the monitor device and has a data connection relationship with the monitor device.

Further, the preset comprises the setting of a preset value, in some preferred embodiments, the preset value can comprise a default value; in some preferred embodiments, the preset value can comprise a preset state; in some preferred embodiments, the preset value can comprise a preset threshold; in some preferred embodiments, the preset value can comprise the default value and the preset state; in some preferred embodiments, the preset value can comprise the preset state and the preset threshold; in some preferred embodiments, the preset value can comprise the default value and the preset threshold; in some preferred embodiments, the preset values may comprise the default value, the preset state, and the preset threshold. In some preferred embodiments, the default value can be a default value of the monitor device in the system; in some preferred embodiments, the preset state can be a preset of various states monitored by the monitor device, which can be used to compare with the state monitored during system operation; in some preferred embodiments, the preset value can be various values that the monitor device can monitor, such as a current value, a voltage value, etc. and can reflect a certain state of the system to a certain degree or independently, and the standard of such a value can be preset, that is, a preset value.

Further, the warning signal comprises an alarm signal and/or an alerting signal and/or a prompt signal. In some preferred embodiments, the warning signal comprises the alarm signal; in some preferred embodiments, the warning signal comprises the alerting signal; in some preferred embodiments, the warning signal comprises the prompt signal; in some preferred embodiments, the warning signal comprises the alarm signal and the alerting signal; in some preferred embodiments, the warning signal comprises the alarm signal and the prompt signal; in some preferred embodiments, the warning signal comprises the alerting signal and the prompt signal; in some preferred embodiments, the warning signal comprises the alarm signal, the alerting signal, and the prompt signal; in some preferred embodiments, the warning signal can comprise a signal that is issued when the merchandise is in an unsafe state; in some preferred embodiments, the alerting signal can comprise a signal that is issued when there is some abnormal work condition in the system; in some preferred embodiments, the prompt signal can comprise interactive prompt information that can be used when the system is working normally.

Further, the function comprises a function of issuing the alarm signal and/or the alerting signal and/or the prompt signal. In some preferred embodiments, the warning signal comprises the alarm signal; in some preferred embodiments, the warning signal comprises the alerting signal; in some preferred embodiments, the warning signal comprises the prompt signal; in some preferred embodiments, the warning signal comprises the alarm signal and the alerting signal; in some preferred embodiments, the warning signal comprises the alarm signal and the prompt signal; in some preferred embodiments, the warning signal comprises the alerting signal and the prompt signal; in some preferred embodiments, the warning signal comprises the alarm signal, the alerting signal, and the prompt signal; in some preferred embodiments, the warning signal can comprise a signal that is issued when the merchandise is in an unsafe state; in some preferred embodiments, the alerting signal can comprise a signal that is issued when there is some abnormal work condition in the system; in some preferred embodiments, the prompt signal can comprise interactive prompt information that can be used when the system is working normally.

In this case, the monitor device can be configured through the intelligent terminal, and the user can connect the interactive controller through the intelligent terminal, preset and configure the monitor device according to the need, and can modify the monitor device in the case of ensuring the security of the system, for example, adding some monitor device, and making a new configuration, or if the content monitored by some monitor device changes, configuration can be performed through the intelligent terminal, generally speaking, only mutually identified monitor device is allowed to be configured by the corresponding intelligent terminal, which ensures the communication security inside the system. In this mode of the present invention, certain data or states can be preset in the monitor device, during the running of the system, the monitored data or states can be compared with these preset data or states to determine whether the warning signal needs to be issued; in addition, as previously mentioned, the monitored data or states can be changed to accommodate different comparison requirements.

In an eighth aspect of the invention, the present invention provides a remotely outputtable monitor device for merchandise security, comprising an identifiable communication interface, the identifiable communication interface can be used to communicate with other devices such that the monitor device can be identified by a device in communication therewith; the remotely outputtable monitor device can be directly or indirectly connected to the merchandise and/or the merchandise display device and configured to be capable of monitoring a connection state of the merchandise and/or the merchandise display device, and issuing a digital warning signal when the connection state is in an abnormal state and/or an unstable state; the remotely outputable monitor device is configured that the digital warning signal remotely outputted by the identifiable communication interface can be recognized and converted into a visual signal and/or an audible signal by the remotely outputtable device, the communication between the monitor device and the remotely outputtalbe device can be realized by the identifiable communication interface described above.

In some preferred embodiments, the connection state refers to the connection state of the merchandise and the merchandise display device, and if the connection state of the merchandise and the merchandise display device is destroyed, the merchandise is likely to be at risk of being stolen; in some preferred embodiments, the connection state refers to the connection state of the merchandise and the monitor device, and the connection between the monitor device and the merchandise can be to ensure the security of the merchandise, if the connection state of the merchandise and the monitor device is destroyed, the merchandise is likely to be at risk of being stolen; in some preferred embodiments, the connection state refers to the connection state of the merchandise display device and the monitor device, in some cases, the anti-theft state of the merchandise is detected by the connection between the merchandise display device and the monitor device, if the connection state of the merchandise display device and the monitor device is destroyed, the merchandise is likely to be at risk of being stolen.

Further, the identifiable communication interface is a wireless communication interface, and the wireless communication interface enables the connection between an intelligent terminal and the monitor device and the position of the monitor device to be more flexible and convenient to operate.

Further, the identifiable communication interface comprises a communication channel and a communication address. In some preferred embodiments, a communication channel comprises at least one channel number configured to identify a communication channel between devices in the warning system, and the channel number is a wireless system channel number; in some preferred embodiments, a communication address is configured to be used for identification of inter-device communication in the system; in some preferred embodiments, the communication address can comprise at least one communication code; in some preferred embodiments, the communication address can comprise at least one device code, which can correspond to a device in the system for identity recognition of the device.

Further, the remotely outputtalbe device comprises the intelligent terminal and/or a cloud-connected device and/or a warning device. In some preferred embodiments, the remotely outputtable device comprises the intelligent terminal; in some preferred embodiments, the remotely outputtable device comprises the cloud-connected device; in some preferred embodiments, the remotely outputtable device comprises the warning device; in some preferred embodiments, the warning device comprises a device capable of issuing the warning signal, and can be some peripheral devices.

Further, the digital warning signal comprises monitor device information and/or warning signal category information and/or warning signal information. In some preferred embodiments, the digital warning signal can comprise monitor device information for referring to the monitor device, the monitor device information can distinguish from which monitor device the digital warning signal is; in some preferred embodiments, the digital warning signal can comprise the warning signal category information for indicating the warning signal category, the warning signal category information can distinguish from which type of the warning signal the digital warning signal belongs to; in some preferred embodiments, the digital warning signal can comprise the warning signal information, the warning signal information refers to the information of the warning signal itself, and can comprise the content of the warning signal; in some preferred embodiments, the digital warning signal can comprise the monitor device information and the warning signal category information; in some preferred embodiments, the digital warning signal can comprise the monitor device information and the warning signal information; in some preferred embodiments, the digital warning signal can comprise the warning signal category information and the warning signal information.

Further, the monitor device information comprises a monitor device number and/or a monitor device name. In some preferred embodiments, the monitor device information comprises the monitor device number; in some preferred embodiments, the monitor device information comprises the monitor device name; in some preferred embodiments, the monitor device information comprises the monitor device number and the monitor device name; in some preferred embodiments, both the monitor device number and the monitor device name can be used for identification, storage, and information interaction of the monitor device.

Further, the warning signal category comprises an alarm and/or an alert and/or a prompt. In some preferred embodiments, the warning signal category comprises the alarm, the alarm herein can be a signal that is issued for a condition in which the merchandise is in an unsafe state, or in which the merchandise can be at risk of theft; in some preferred embodiments, the warning signal category comprises the alert, the alarm herein can refer to a signal issued in a state in which some devices in the system can not be in a normal work state, or in a state in which the system or some devices in the system is not in a stable operation, or in a state in which some monitored values or monitored states in the system are not preset or expected; in some preferred embodiments, the warning signal category comprises the prompt, the prompt herein can be some interactive prompt information which the system can use during functioning properly, such as a tip for merchandise being experienced.

Further, the warning signal information comprises a connection state of the monitor device and the merchandise and/or a connection state of the monitor device and the merchandise display device. In some preferred embodiments, the warning signal information comprises the connection state of the monitor device and the merchandise; in some preferred embodiments, the warning signal information comprises the connection state of the monitor device and the merchandise display device; in some preferred embodiments, the connection in the connection state can be a physical connection; in some preferred embodiments, the connection in the connection state can be an electrical connection; in some preferred embodiments, the connection in the connection state can be a signal connection. If the content of the warning signal information is the connection state, in some cases, the system can issue different warning signals according to the content change of the warning signal information; in some preferred embodiments, if the connection state is destroyed or abnormal or unstable, the system can issue the warning signal.

Further, the connection state comprises a normal state or an abnormal state or a stable state or an unstable state. In some preferred embodiments, the connection state comprises the normal state; in some preferred embodiments, the connection state comprises the abnormal state; in some preferred embodiments, the connection state comprises the stable state; in some preferred embodiments, the connection state comprises the unstable state. In some preferred embodiments, for the same connection, one time can have only one state, such as the normal state, or the abnormal state; in some preferred embodiments, since there is a plurality of connections in the same system, and different connections can be in different states, the system comprise a plurality of different states at the same time that exist simultaneously. In some preferred embodiments, the normal state and the abnormal state are relative, the normal state usually indicates a normal work or safe state, and the abnormal state can be the abnormal work state or the unsafe state; in some preferred embodiments, the stable state and the unstable state are relative, the stable state usually indicates that a certain state can be continuously maintained for a period of time, or a certain value is constant or maintained within a certain range for a certain period of time, the stable state can be the opposite.

In this case, the monitor device in the warning system can communicate with the remotely outputtable device through the identifiable communication interface, and transmit to the remotely outputtable device some information monitored by the monitor device through a communication manner that can comprise data or states, the remotely outputtable device can belong to a portion of the system, or a plurality of peripheral devices. If the remotely outputtable device is a portion of the system, the remotely outputtable device can be set for safety, If the remotely outputtable device is the peripheral device of the system, some security measures can be taken, in this way, the warning signal monitored by the monitor device can be transmitted remotely, therefore, even if the staff are not in a store, the information on the store can still be received by the staff, or off-site staff can also receive information in site in this way, which expands the application of the anti-theft system and enhances the application convenience and diversification of the anti-theft system.

The beneficial effects of the invention are:

(1) The warning system of the present invention can comprise three main components: the controller, the monitor device and the warning device, wherein the controller can initialize the monitor device and the warning device to establish an internal relationship to form a unique communication relationship with an exclusive function and be capable of ensuring that the communication relationship of the system is safe and effective, and this initialization can be repeatedly reproduced, therefore, if any device in the system changes or needs to be reconfigured, the new system can be configured by re-initialization, no hardware change is needed, no key is needed to rewrite, which makes the system have both security and extensibility. The initialized controller can control the monitor device and the warning device, such as unlocking.

(2) The warning system of the present invention introduces the intelligent terminal as a way of configuring the controller and the monitor device, and the intelligent terminal can establish a connection with the controller and the monitor device through a wireless manner, and the intelligent device with a very user-friendly man-machine interaction manner can easily configure and connect the controller and monitor device, and the intelligent device can also be configured accordingly, so that the manner that the controller and the monitor device can communicate with the intelligent device can meet the requirements of the anti-theft system, then in this case, the intelligent device can interact with the monitor device or the controller, control the controller, or control the monitor device, or control the monitor device through the controller, even serves as the output device for some signals in a warning system (3) The present invention can preset the warning device and the monitor device to adjust the warning mode of the warning device and the sequence of the warning device to transmit the warning signal, and expand the application scenario and performance of the warning device, so that the application of the warning device is more user-friendly, or, the monitor device is preset and configured according to needs, in the case of ensuring the security of the system, the configuration of the monitor device can be changed, in the mode of the present invention, the monitor device can be preset with the data or states, the monitored data or states that are monitored by the monitor device can be compare with the preset data or states during the operation of the system to determine whether the warning signal needs to be issued; moreover, as previously mentioned, the monitored data or states can be changed to accommodate different comparison needs.

(4) The monitor device of the present invention comprises, but is not limited to, a conventional anti-theft device, and can monitor not only whether the merchandise is in the safe state, but also whether various devices in the system are in the normal work state, once such normal work state is destroyed or the balance is broken, even if there is not a set anti-theft state, for example, the merchandise can be in a state at risk of being stolen, the monitor device can monitor and feedback based on the operation of the system itself, such as issuing an alarm signal, the monitor device can prompt the work state of the system in time, which is convenient for system maintenance, and can effectively prevent loopholes that cannot be detected due to the failure of the system itself but cannot be found by the staff.

(5) The present invention also has an extended function of remote output, and the monitor device of the present invention can communicate with the remotely outputtable device through the identifiable communication interface, and can monitor certain information, which can comprise the data or the states, and transmit the information to the remotely outputtable device by means of communication, which expands the application mode of the anti-theft system, and improves the application convenience and diversification of the anti-theft system.

BRIEF DESCRIPTION OF DRAWINGS

FIG. 13 is a flow diagram of the processing of a monitor device according to the present invention.

FIG. 14 is a packet format of a warning signal according to the present invention.

FIG. 15 is a diagram of a format of a payload of a warning signal according to the present invention.

FIG. 16 is a warning signal priority, a signal code and a warning enabling table according to the present invention.

FIG. 17 is a preset data packet format according to the present invention.

FIG. 18 is a preset payload format according to the present invention.

FIG. 19 is a table of a preset category/a subcategory data according to the present invention.

DETAILED DESCRIPTION

Figure 1:
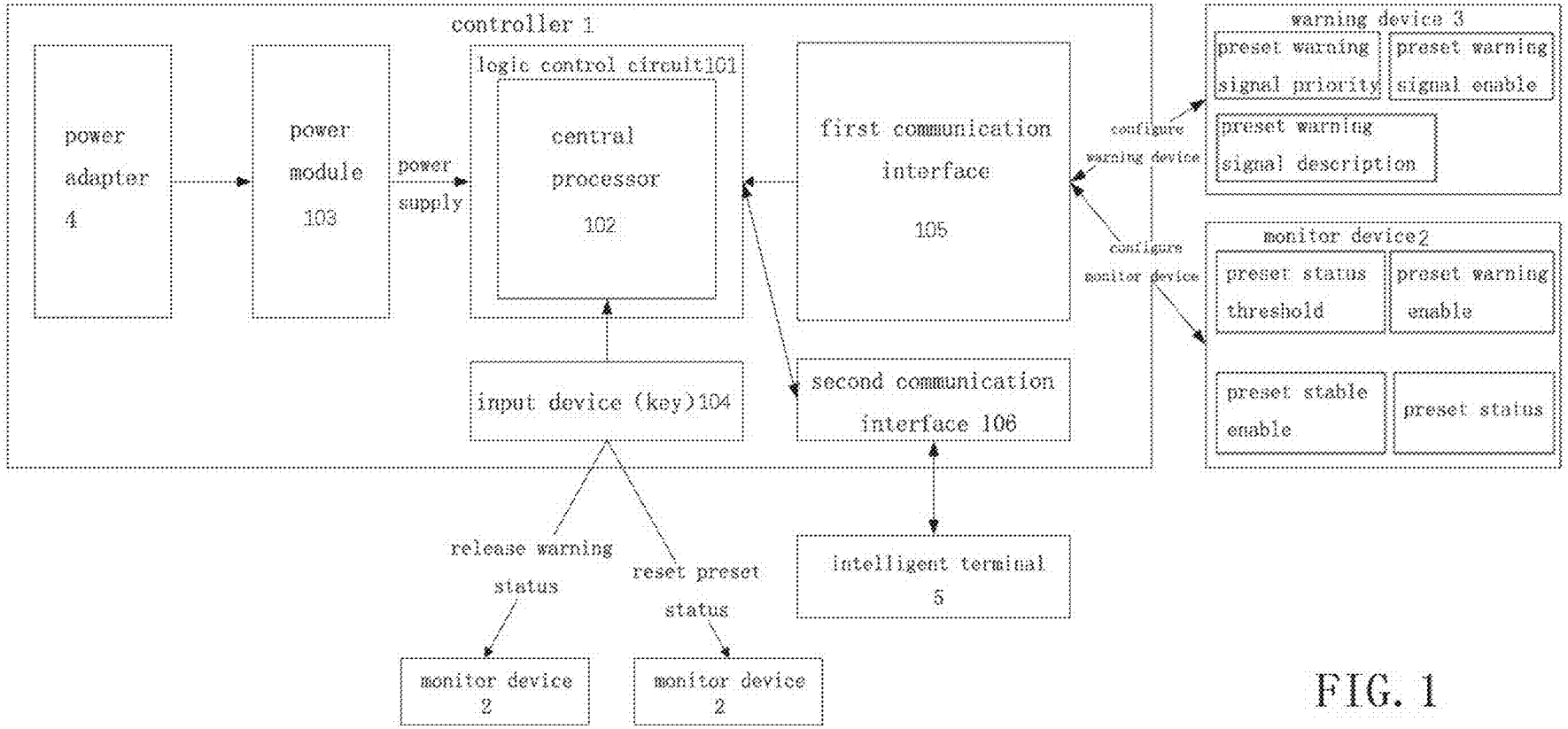
FIG. 1 is a block diagram of the overall structure of a warning system according to the present invention.

The technical terms involved in the present invention are explained in conjunction with the embodiments, and the explanation of terms is explained in order to enable a person skilled in the art to more accurately understand the technical solutions of the present invention, the explanation of the terms does not limit the scope of protection of the present invention.

Merchandise Security

The merchandise security referred to in the present invention comprises anti-theft of a merchandise and a plurality of other states of the merchandise related to the anti-theft, such as a safe state and a normal state or a stable state of a merchandise anti-theft device.

In general, merchandise anti-theft can be used for a plurality of commodities that need to be functionally displayed to a purchaser or a potential purchaser, such as an electronic merchandise, a plurality of functions of these commodities need to be understood by the user only when the commodities are used, these commodities usually have a plurality of man-machine interaction interfaces. An exhibited person can contact and use all or part of the functions of these commodities by demonstration or display in a certain range, so as to understand the performance of the merchandise, in the industry, this kind of merchandise with a functional display demand is also called as the merchandise with experiencing demand, that is, the exhibited person can operate and experience the merchandise displayed under limited conditions and scope, therefore, these commodities can be experienced or directly contacted by the experiencer, the experiencer can use the merchandise within the limit defined by the seller or the owner of the merchandise, such as a sales place, but cannot take the merchandise away from an experience place, since the ownership of the displayed merchandise belongs to the seller or the owner, the merchandise needs to be taken with anti-theft measures, these anti-theft measures do not limit the use of the experiencer, but only limit the experiencer to take the merchandise away from the place, in some cases, these anti-theft measures need to be considered as far as possible not to hinder the use of the experiencer, so that they can get better experience, which is different from the anti-theft measures of items in volume sales, the anti-theft measures of the merchandise can also be taken in some ways that do not require experience and just display for sales, such as a rack for displaying and storing the merchandise, in addition, the anti-theft measures of the merchandise can also be taken for an area that does not require experience or display, such as a storage area of the merchandise, or, for example, a cabinet for storage, wherein if the merchandise is stored therein, the area can also be covered by the anti-theft measures. Meanwhile, this does not set a merchandise lock on the merchandise itself, but a plurality of controllable anti-theft system or anti-theft settings are used to perform anti-theft from a overall layout and the ability to remotely or close to unlock the merchandise, in a sense, the anti-theft can be an anti-theft concept of a region or a place.

The state of the anti-theft system of the merchandise can comprise the work state and the non-work state of the anti-theft system of the merchandise, for the work state, if the anti-theft system of the merchandise can operate normally under the expected state, such as normal alarm, normal indication, etc., it can be considered that the system is in a normal work state, and vice versa, it can be considered that the system is in an abnormal work state, in the present invention, the abnormal work state can also be sensed or monitored by the monitor device and fed back by the warning device, if a device is in the abnormal work state in the anti-theft system of the merchandise, the device can affect the normal function of the merchandise anti-theft, therefore, if there is no effective guarantee for the state of the system itself, then the system cannot guarantee actually the anti-theft performance of the system. In some preferred embodiments, the non-work state of the anti-theft system of the merchandise can also be comprised, because the non-work state can also be related to some performance of the anti-theft system, such as the security of the system itself, or the privacy or exclusion of the system, if the system does not have good exclusion to guarantee that only the devices in the system can communicate with each other, the system itself is not safe, it is possible that a certain peripheral can also control the devices in the system, the so-called system is easy to be "blackened", in this case, security cannot be guaranteed, therefore, the internal state of the anti-theft system of the merchandise needs to be effectively set.

In terms of merchandise security, it can be considered that the merchandise are in two states of the safe state and/or the unsafe state, the safe state and the unsafe state are relatively, and are mainly used in the anti-theft of merchandise, the purpose of the anti-theft of merchandise is to keep the merchandise in the safe state, in the event that the merchandise is unsafe or can be in the unsafe state, a warning is required to prompt the staff in the sales place or the display place. The safe state or the unsafe state refers to the state in which the merchandise is displayed, in particular, the state in which the merchandise is displayed in association with the antitheft device when the antitheft device is installed, in general, the state of the merchandise that is considered not to be stolen is called the safe state. The state that the merchandise can be stolen is called the non-safe state, if the anti-theft measures are intact, and if the merchandise are under the protection of anti-theft measures, it is considered to be the safe state, otherwise, it is considered to be the unsafe state, that is to say, the safe state or the unsafe state is relative to the anti-theft measures, for example, the anti-theft measures is to always connect the displayed merchandise with a charging interface, a sensor detects whether the charging interface is always connected to the merchandise, if so, the merchandise is in the safe state, if not, the merchandise is in the unsafe state; or, if the anti-theft measures is to keep the merchandise in a charged state, the sensor detects whether a charging cable of the merchandise maintains power transmission, if so, the merchandise is in the safe state, if not, the merchandise is in the unsafe state; or, if the anti-theft measure is that the merchandise is clamped by a clamping device, the sensor detects whether the merchandise is in a clamping space or whether the merchandise remains contact or installation with the clamping device, if yes, in a safe state, if not, in an unsafe state; and so on.

Controller

In the field of merchandise anti-theft, a controller is to some extent an unlocker, when an anti-theft device such as an alarm give alarming sound, the alarm can be turned off by the controller to stop the alarm, which is one function of the controller, in some cases, the anti-theft device can set a switch that will act as an anti-theft when the switch is turned on, when the switch is turned off, the alarm will stop, in some cases, the controller can also control this on and off. Most controllers can function as the unlocker and the switch.

Monitor Device

The monitor device in the present invention can comprise a conventional merchandise anti-theft device, such as an anti-theft device, an anti-theft host, etc., and can also comprise equipment related to merchandise security, which can monitor and control equipment in the merchandise security system, the monitoring mainly refers to the perception and acquisition of some data information and state information, and even storage, the control can be the comparison and determination of the obtained information, thereby outputting a plurality of required instructions, which can be executed by other devices in a warning system. Such an execution of such the instruction can usually be a state in which the warning system is externally displayed, such as issuing an alarm signal. The monitor device can comprise a monitoring circuit and an induction circuit, wherein the induction circuit can be directly or indirectly connected or attached to a merchandise or a merchandise display device, or is installed in an environment where the merchandise is located, and is used for sensing information required by certain systems, the induction circuit can transmit to the monitoring circuit the signal that the induction circuit senses, and the monitoring circuit compares and determines the information sensed by the induction circuit to determine whether the warning signal needs to be issued.

The monitor device can issue the warning signal, but the warning signal is not necessarily the warning state displayed by the system, and the warning state can be externally performed by other devices, for example, the device to be executed can be the warning device.

Warning Device

The warning device in the present invention can comprise an alarm device in a conventional merchandise anti-theft system for issuing an alarm signal, and can also comprise a plurality of devices capable of issuing other signals, such as a device that issues a prompt signal, or a device that issues a warning signal, further, in addition to the conventional alarm signal, the warning device of the present invention can also expand the form of the alarm signal, for example, adding a visual signal and a haptic signal.

Preset and Configuration

The monitor device and the warning device can be preset in the present invention, the preset content can comprise a preset threshold, a preset state, and a preset function, a preset object can be the controller, the monitor device, the warning device and various equipment in a warning system. In some preferred embodiments, the preset can also be considered a configuration, for example, a presettable device can be a device capable of configuring a plurality of internal function settings or performance parameter settings thereof.

Taking the monitor device as an example to explain the preset and the configuration, the presettable or configurable monitor device can be preset and configured by other devices or peripheral devices in the system, and the preset and configured content comprises the system, the work state, a function parameter and a performance parameter. These preset devices can configure the monitor device through the preset threshold, the preset state, the preset stability threshold and the preset warning enabling; the presettable or configurable monitor device opens the function, the performance and the state to other devices and even peripheral devices, greatly facilitating the custom settings of the configurable monitor device, so that the configurable monitor device is more personalized and diverse.

The preset threshold can comprise a vibration induction threshold, a movement induction threshold, a magnetic field induction threshold, a pressure induction threshold, a connection induction threshold, a current induction threshold, a voltage induction threshold, a light induction threshold, an infrared induction threshold, and a temperature induction threshold value, etc. In some preferred embodiments, the actual values of the foregoing thresholds can be acquired by an induction circuit, the configuration of the preset threshold can be limited by a state value of the induction circuit, so the state value has upper and lower limits, the preset threshold is taken within the limits of the upper and lower limits. A monitoring circuit in the monitor device can monitor the information sensed by the induction circuit, if the monitor device detects that the state value in the induction circuit deviates from the preset state threshold, the monitor device determines whether the state is in an abnormal state according to the preset state. If the state is in the abnormal state, the monitor device will output the warning signal when the warning is enabled; if the warning is disabled, the monitor device will be muted; if the state is in the normal state, the monitor device is also muted.

The preset state can be divided into a normal state and the abnormal state. When the monitor device is configured, it can be configured that the preset state is the normal state under some conditions, and is the abnormal state under other conditions, that is, the normal state and the abnormal state are redefined according to the customer's needs; further, the monitor device can also redefine the normal state and the abnormal state according to the own state, the state that can be defined or configured in the monitor device can comprise the safe state and the unsafe state of the merchandise, and can also comprise a more detailed state, such as a connection state of the merchandise, a disconnected state of the merchandise, and an unstable state of the merchandise, a charging state of the merchandise and the non-charging state of the merchandise, an access state of the adapter, a disconnected state of the adapter, and the unstable state of the adapter. In the configuration and preset of the monitor device, the above states can be defined as the normal state and the abnormal state, the states defined by the normal state and the abnormal state are opposite aspects. For example, if the normal state is defined as the safe state of the merchandise, the abnormal state is automatically defined as the unsafe state of the merchandise.

Therefore, the normal state configured and defined here is not a normal state in the conventional sense, similarly, the abnormal state is not the abnormal state in the conventional sense. For example, in the traditional sense, the connection state of the merchandise is defined as the normal state, and the disconnected state and the unstable state of the merchandise are defined as the abnormal state, and the monitor device can also define the normal state and the abnormal state according to the conventional meaning. In addition, the monitor device can define the disconnected state and the unstable state of the merchandise as the normal states, and define the connected state of the merchandise as the abnormal state.

Therefore, setting the preset state to the safe state of the merchandise or the non-safe state of the merchandise will be controlled externally. The monitor device determines whether the state is the normal state or the abnormal state based on the preset state. For example, when the preset state of the configured monitor device is the charging state of the merchandise, then when the monitor device detects that the merchandise is not in the charging state, the monitor device will determine that the merchandise is in the abnormal state. Conversely, when the preset state of the configured monitor device is the non-charging state of the merchandise, then when the monitor device detects that the merchandise is in the charging state, the monitor device determines that the merchandise is in the abnormal state; if the monitor device detects that the merchandise is not in the charging state, the monitor device will determine that the merchandise is in the normal state.

The preset state not only supports user definition, but also supports a controller preset state. When the monitor device is in the abnormal state and the warning signal is issued, the controller can release the warning signal. The controller releases the warning signal by grading: when the controller button is touched for a short time, the controller releases the warning signal; when the controller button is touched for a long time, the controller releases the warning signal and changes the preset state. When the controller button is touched for a short time, the controller releases the warning signal of the monitor device, when the monitor releases the warning signal, the warning signal will continue to be issued when the abnormal state is detected again because the preset state has not changed. In contrast, when the controller button is touched for a long time, the controller releases the warning signal of the monitor device, when the monitor device releases the warning signal, the preset state of the monitor device is reversed, since the normal state and the abnormal state have been redefined at this time, if the state monitored by the monitor device is the normal state, no warning signal will be issued.

The preset state can also be changed according to the state of the monitor device itself. For example, when the anti-theft merchandise is connected to the monitor device, the monitor device can preset the state according to a connected state and an unconnected state of the anti-theft merchandise The monitor device controls the determination of the abnormal state through the preset threshold, and controls the determination of an abnormal logic through the preset state, and the determination of the state value affects the determination of the abnormal logic, so the monitor device controls the abnormal logic of the entire system through the preset state threshold and the preset state.

A stability threshold can also be preset, the stability threshold is a combination of the state and the threshold, the stability is the state, the stability threshold is to express stability by the threshold, the stability is a feature used to characterize whether the monitor device and the peripherals thereof work reliably. The monitor device and the peripherals thereof have the stable state and the unstable state. When the monitor device and the peripherals thereof do not work reliably, the monitor device is set to be in the unstable state; when the monitor device and the peripherals thereof work reliably, the monitor device is set to the stable state. The stable state and the unstable state have an impact on the determination of the normal state and the abnormal state. The monitor device and the peripherals thereof in the unstable state can always be determined to be in the normal state or the abnormal state all the time, or can be determined to be the normal state and the abnormal state alternately; the preset stability threshold can be used to determine whether the monitor device and the peripherals thereof are in the stable state or the unstable state; the configurable stability threshold in the monitor device is affected by the nature of the actual monitor device and the peripherals thereof, or has the upper and lower limits of the stable value, or is defined by a similarity threshold of a stability curve or is defined by a concentration threshold of a stability distribution.

Correspondingly, the stability threshold can be configured as a stability value, the stability curve, and the stability distribution. When the monitor device detects that the stability of the monitor device and the peripherals thereof deviates or destroys the stability value, and/or the stability curve, and/or the stability distribution, the monitor device determines that the merchandise is in the unstable state; when the monitor device is in the unstable state, the monitor device outputs the warning signal when the warning is enabled; if the warning is disabled, the monitor device will be muted; if the merchandise is in the stable state, the monitor device is also muted.

In addition, the stability thresholds of a cable and an adapter can also be preset in the monitor device, when the stability of the cable deviates or the stability threshold is destroyed, it indicates that the cable work is no longer reliable, the anti-theft security device may be still in a normal state and can normally trigger the cable to enter the abnormal state, but the cable needs to be replaced because the cable is no longer reliable and may fail at any time and cause the security device to fail.

Warning enabling is relative to Warning disabling. The warning enabling refers to a function that can perform some kind of warning operation, the warning disabling refers to that even if some kind of the warning operation can be performed, the warning operation is not temporarily performed, or even if some kind of warning state is generated, the warning operation is not performed, the warning disabling is equivalent to prohibiting some kind of warning enabling. The monitor device can be configured to be capable of outputting the warning signal, presetting the warning enabling is to preset the condition under which the monitor device outputs the warning signal, otherwise, even if the monitor device can output the warning signal, the monitor device does not output the warning signal when the monitor device is in the conditions of the non-preset warning enabling; for example, when the monitor device and the peripherals thereof are in the abnormal state or the unstable state, the monitor device can be configured to output the warning signal through a preset warning enabling. When the monitor device presets the warning enabling, when the monitor device and the peripherals thereof are in the abnormal state or the unstable state, the monitor device outputs the warning signal; when the monitor device does not have the preset warning enabling, when the monitor device and the peripherals thereof are in the abnormal state or the unstable state, the monitor device does not output the warning signal. Outputting, by the monitor device, the warning signal comprises that the monitor device itself outputs the warning signal or remotely outputs the warning signal by means of a wired/wireless manner.

The preset state threshold, the preset state, the preset stability threshold, and the preset warning enabling of the monitor device may be separately configured. Therefore, the configurable monitor device may have only the preset state threshold, or only the preset stability threshold, or only the preset state threshold and the preset state, and the like. The above four preset modes can arbitrarily arranged and combined.

The above presets all take the monitor device as an example, the warning device can also be configured accordingly, the warning device can be preset and can comprise warning signal priority. After the warning signal priority is preset, the preset warning signal can transmit the warning signal based on a priority sequence; the warning device can be preset and can further comprise warning signal description. In some preferred embodiments, the warning signal description can comprise warning signal content, for example, if the cable is abnormal, the warning content can be that the cable may be abnormal, or if the connection can be abnormal, the warning content can be abnormal, the warning device can be preset and can further comprise a warning signal enabling, the warning signal enabling is similar to the warning enabling in the monitor device and is a certain function of the warning signal, when the warning signal enabling is preset, the warning device can issue the warning signal according to the preset warning signal, otherwise, there may be warning signal disabling, the warning signal can not be issued under non-preset conditions.

The preset content can be collectively referred to as the preset value, the preset value is embodied in a data packet format in the monitor device and the warning device, the data packet format of the preset value is as shown in the table in FIG. 17, the payload format of the preset value is as shown in the table in FIG. 18, and the data format and description of the category and the subcategory of the preset value are as shown in the table in FIG. 19.

Warning Signal

In the present invention, the warning signal comprises the warning signal for warning the abnormal state and the warning signal for warning the unstable state, and the so-called abnormal state mainly refers to conditions that the merchandise and the device are abnormal, the so-called unstable state mainly refers to the state of damage of a wire and the service life of the monitor device.

Two different types of warning signals can be generated in different ways, for example, the warning signal for warning the abnormal state can be generated by: the monitor device can preset the state threshold, the preset state, and the preset warning enabling in advance, which can be adjusted by the peripherals. The induction circuit obtains one real-time sampling value by sampling, analysis and processing, compares the sampling value with the preset state threshold, and accordingly generates a new induction circuit state, and compares the new state with the preset normal state, to determine whether the abnormal state is generated. If one new abnormal state is generated, it is determined whether the state is enabled by the preset warning, if so, the monitor device converts the abnormal state into the warning signal for warning the abnormal state, and then issues the warning signal; if not, the monitor device does not issue the warning signal. The warning signal for warning the unstable state can be generated by: the monitor device presets the stability threshold and the preset warning enabling in advance, which can be adjusted by the peripherals. The induction circuit detects that the sampled value deviates from the preset stability threshold by sampling and analysis, which generates the unstable state. A detection device determines whether the state is enabled by the preset warning, if so, the monitor device converts the unstable state into the warning signal for warning the unstable state, and then issues the warning signal; if not, the detection device does not issue a warning signal.

The warning signal can be directly issued through an alarm circuit of the monitor device itself, after the monitor device issues a warning signal, it will first be determined whether the alarm circuit itself is idle, if so, the monitor device converts the warning signal into a human-recognizable warning signal according to the type of the warning signal and through the alarm circuit; if not, the monitor device adds the newly issued warning signal to a warning signal queue to be handled later. Alternatively, the warning signal can also indirectly issue the warning signal through the peripherals; the monitor device transmits the generated warning signal to an external output device by a wired manner or a wireless manner, and the external output device converts the warning signal into the human-recognizable warning signal after the external output device receives the warning signal.

For the warning signal for warning the abnormal state, when the monitor device receives the instruction to stop transmitting the warning signal, the warning signal stops to be transmitted; then the sampling and the determination are continued, the determination result is that if the warning signal is not in the abnormal state, the warning signal stops to be transmitted, otherwise, the warning signal is continuously transmitted; alternatively, the preset state of the monitor device is modified to change the original preset state, and then the state obtained by the sampling is compared with the modified state, if the state obtained by the sampling is determined to be normal, the warning signal stops to be transmitted, otherwise, the warning signal is continuously transmitted. For the warning signal for warning the unstable state, when the sampling value of the induction circuit returns to a normal value range; alternatively, the preset stability threshold of the monitor device is modified, so that the sampling value is in the normal value range; alternatively, if the monitor device receives an instruction to stop transmitting the warning signal, the monitor device stops transmitting the warning signal for warning the unstable state. If the deviation distance of the sampling value of the induction circuit reach a new range, the warning signal is transmitted again; alternatively, if the sampling value sampled by the induction circuit deviates from the preset stability threshold limit range, the warning signal is transmitted, at this time, if the monitor device receives the instruction to stop transmitting the warning signal, the monitor device stops transmitting and does not transmit again, if the sampled value of the induction circuit returns to the normal range, an interface is re-determined.

The warning signal can be divided into a visual warning signal (e.g., comprising lighting, an image, etc.), an audible warning signal (e.g., comprising sound), a haptic warning signal (e.g., comprising vibration), etc., depending on the senses acting on the person. In some preferred embodiments, the visual warning signal can use color to distinguish a signal level, red for the alarm, orange for the warning, yellow for the prompt, green or white for the normal. In some preferred embodiments, the audible warning can be distinguished by sound having different frequencies, timbres, and intensities. In some preferred embodiments, in order to enhance the reliability of the warning signal, the visual and audible forms can be employed. In some preferred embodiments, the warning signal can be classified into the alarm, the alert, the prompt, a message, etc. according to the degree of urgency of the warning. In some preferred embodiments, the degree of urgency of the warning signal is decreased in turn.

In some preferred embodiments, the warning signal can be the digital warning signal, the digital warning signal can be used for wired or wireless transmission between the devices. The packet format of the digital warning signal is shown in the table in FIG. 14, where the payload format is as shown in the table in FIG. 15, and the priority, the signal code, and the warning enabling of the warning signal are shown in the table in FIG. 16.

Interaction

In the present invention, the meaning of interaction is to transfer data to each other, and/or to receive control from each other, and/or to communicate with each other, for example, data interaction or information interaction or control interaction. In some preferred embodiments, most devices in the system can interact with other devices; in some preferred embodiments, one device can interact with other multiple devices respectively; in some preferred embodiments, one-to-one interaction can be performed between the devices; in some preferred embodiments, one device can interact with two devices at the same time, which is called as a bridge of the interaction of two other devices, for example, when the intelligent terminal configures the monitor device or the warning device through the controller, the controller can act as a bridge for interaction of the intelligent terminal and the monitor device or the warning device; in some preferred embodiments, the interaction can be used for configuration or preset; in some preferred embodiments, the interaction can be used for control.

When devices in the system can interact with each other, this warning system can be called as an interactive warning system, when a device can interact with other devices, the device can be called as an interactive device, such as an interactive controller, the interactive monitor device or the interactive warning device.

Identification

The identification in the present invention refers to the identification on the interaction, only the devices that can be identified by each other can interact, the identification can be matched through the existing methods or can be encrypted through a special channel and a special communication address, which allows devices in the same system or devices communicating with each other to be identified with each other, thereby realizing interaction, and thus enabling the device in the system to control or be controlled to complete the function of the warning system.

A Plurality of Specific Embodiments

The embodiments of the present invention are further described in detail below with reference to the accompanying drawings. It should be noted that the embodiments are only illustrative of the present invention and should not be construed as limiting the present invention.

FIG. 1 is a block diagram of a typical system structure of the present invention, as shown, the warning system of the present invention comprises a controller 1, a monitor device 2, and a warning device 3, between which interaction can be established, in some preferred embodiments, the controller 1 can identify the monitor device 2, and vice versa; in some preferred embodiments, the controller 1 can also identify the warning device 3, and vice versa.

In some preferred embodiments, the controller 1 comprises a logic control circuit 101, which can be used to perform a control operation, this control operation can use a conventional control algorithm, such as a logic operation, or can also additionally set according to actual requirements, the logic control circuit comprises a central processor 102 for processing an instruction input to the controller 1 and converting the instruction into data or information that is transmitted to an execution device, in some preferred embodiments, the execution device can be other devices in the warning system, for example, the monitor device or the warning device.

In some preferred embodiments, the controller 1 can comprise a power module 103 for powering the logic control circuit 101 and the central processor 102; in some preferred embodiments, the power module 103 can also power other function modules within the controller 1; in some preferred embodiments, the power module 103 can be externally connected to a power adapter 4; in some preferred embodiments, the power module 103 can be externally arranged to the controller 1.

In some preferred embodiments, the controller 1 can comprise an input device 104, such as a button, for inputting an external control instruction to the controller 1; in some preferred embodiments, the input instruction can comprise releasing the warning state; in some preferred embodiments, the input instruction can comprise resetting the preset state and the like.

In some preferred embodiments, the controller 1 can comprise a first communication interface 105 for communicating with the warning device 3, and the controller 1 can configure/preset the warning device 3 through the first communication interface 105, or can control the warning device 3.

In some preferred embodiments, the controller 1 can comprise a first communication interface 105 for communicating with the monitor device 2, the controller 1 can configure/preset the monitor device 2 through the first communication interface 105, or can control the monitor device 2. The first communication interface in communication with the monitor device 2 and the first communication interface in communication with the warning device 3 can be the same interface.

In some preferred embodiments, the first communication interface 105 can be a wired or wireless communication interface, and can configure an interface manner according to actual needs, when the first communication interface 105 is a wired interface, the first communication interface 105 can be preset or controlled by the wired manner, when the first communication interface is a wireless interface, the first communication interface can be preset or controlled by a wireless manner.

In some preferred embodiments, the controller 1 can communicate with the intelligent terminal 5 through the second communication interface 106, such communication can comprise identification and interaction; in some preferred embodiments, the second communication interface 106 is a wireless communication interface; in some preferred embodiments, the intelligent terminal 5 can configure the warning device 3 and/or the monitor device 2 through the controller 1.

Figure 2:
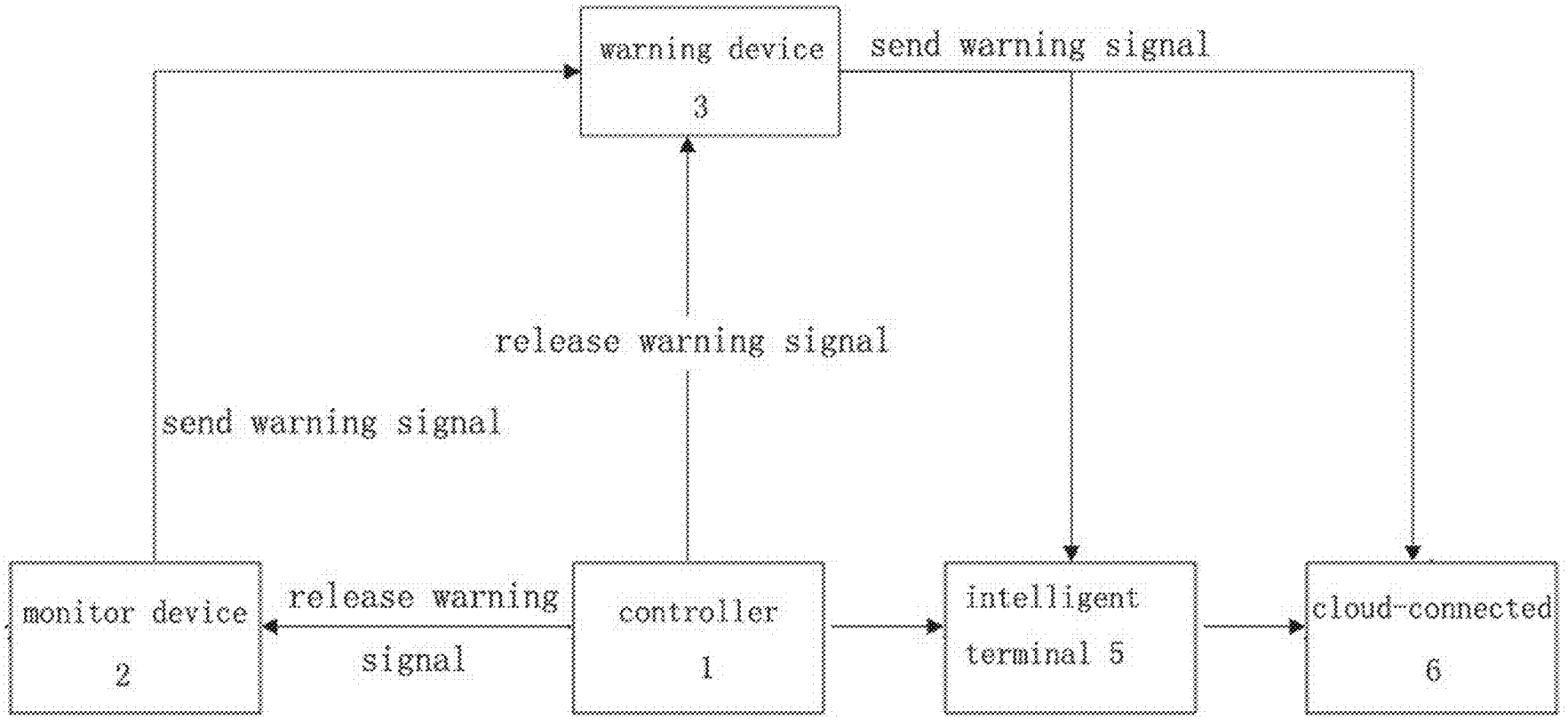
FIG. 2 is a work flow chart of a warning system according to the present invention.

FIG. 2 is a block flow diagram of a typical system of the present invention. As shown in the figure, the controller 1 can respectively issue a control instruction for releasing the warning signal to the monitor device 2 and the warning device 3, and accordingly, the monitor device 2 and the warning device 3 can execute the instruction of the controller respectively. In some preferred embodiments, the monitor device 2 can issue the warning signal to the warning device 3; in some preferred embodiments, the warning device 3 can issue the warning signal according to the instruction of the monitor device 2; in some preferred embodiments, the warning, the warning signal issued by the warning device 3 can be fed back to the intelligent terminal 5; in some preferred embodiments, the intelligent terminal 5 can display the warning signal issued by the warning device 3 to warning or prompt a holder or a user of the intelligent terminal 5, in some preferred embodiments, the intelligent terminal 5 can also be connected to the cloud-connected 6 to synchronize the information of the intelligent terminal 5 to the cloud-connected 6; in some preferred embodiments, the warning signal issued by the warning device 3 can be transmitted to the cloud-connected through the intelligent terminal 5; in some preferred embodiments, the warning device 3 can also be connected to the cloud-connected 6, and can transmit the warning signal directly to the cloud-connected 6 without using the intelligent terminal 5.

Figure 3:
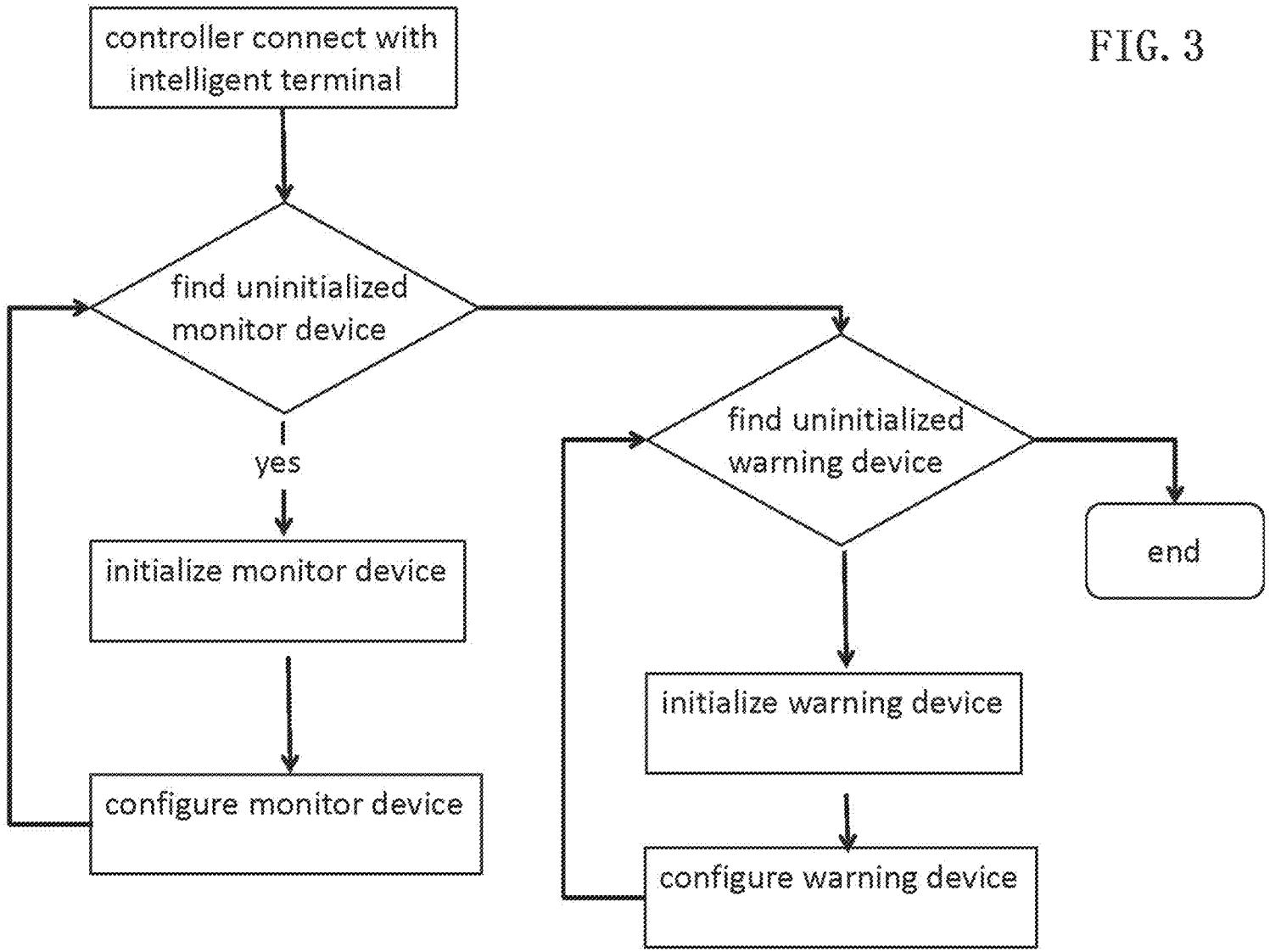
FIG. 3 is a flow chart of the initialization of a warning system according to the present invention.

FIG. 3 is a flow chart of a typical initialization of the present invention, before initialization, it is necessary to ensure that the controller can establish communication/interaction with the monitor device and the warning device that need to be initialized, that is to say, the controller be identified each other with the monitor device and the warning device that need to be initialized.

The initialization process is as shown in the figure, the controller is connected to the intelligent terminal, the user can control the start of the initialization through the intelligent terminal, when the initialization is performed, it is needed to first find out whether there is an uninitialized monitor device, if so, the monitor device is initialized, the initialized content is the above preset and configuration; if not, it is needed to check whether there is an uninitialized warning device, if so, the warning device is initialized, and the initialized content is the above preset and configuration, if not, the initialization is ended.

In some preferred embodiments, the controller 1 can also directly initialize the monitor device and/or the warning device without using the intelligent terminal.

Figure 4:
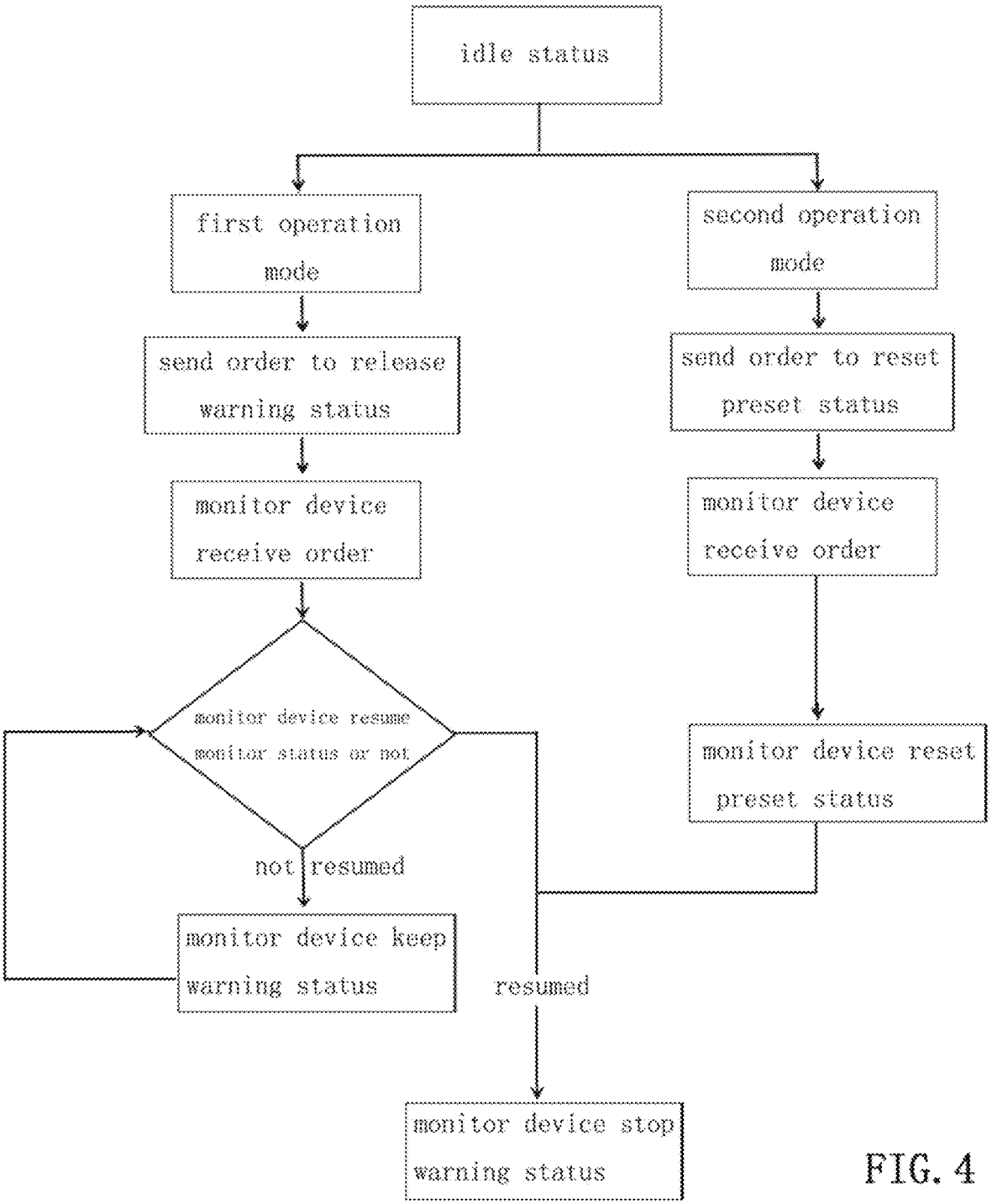
FIG. 4 is a control flow chart of a controller according to the present invention.

FIG. 4 is a control flow chart of a typical controller of the present invention, as shown in the figure, the controller can comprise two operation modes, the two operation modes can control the monitor device respectively and independently, the two operation modes are respectively a first operation mode and a second operation mode, in some preferred embodiments, the controller can be preset to have the two different operation modes, the two operation modes is switchable in some manner, for example, some switch button or some button mode is set on the controller.

In the first operation mode, the operation of the monitor device by the controller can be the instruction to release the warning state, as shown in the left column, when the controller issues the instruction to release the warning state to the monitor device, the monitor device receives the instruction, the monitor device determines whether the state of the original warning signal issued in the warning system has been restored, if so, the monitor device executes the instruction and releases the warning state, if not, the monitor device continues the warning state until the next instruction is received. For example, when the alarm in which the merchandise is in an unsafe state is issued, the staff want to release the alarm through the controller, at this time, the monitor device performs inspection and determination, if the non-safe state still exists, the alarm is continued to prompt the staff that the risk has not been released.

In the second operation mode, the controller can operate the monitor device to issue the instruction to reset the preset state, as shown in the right column, when the controller issues the instruction to reset the preset state to the monitor device, the monitor device receives the instruction and resets according to the requirements of the instruction, if the monitor device is in the warning state, the alarm state is released while resetting. For example, if there is no need to make the alarm in a certain scenario, at this time, the general setting of the monitor device can generate the alarm, when the warning state occurs, the monitor device can be adjusted in time through the second operation mode to adapt to the requirements of different occasions.

Figure 5:
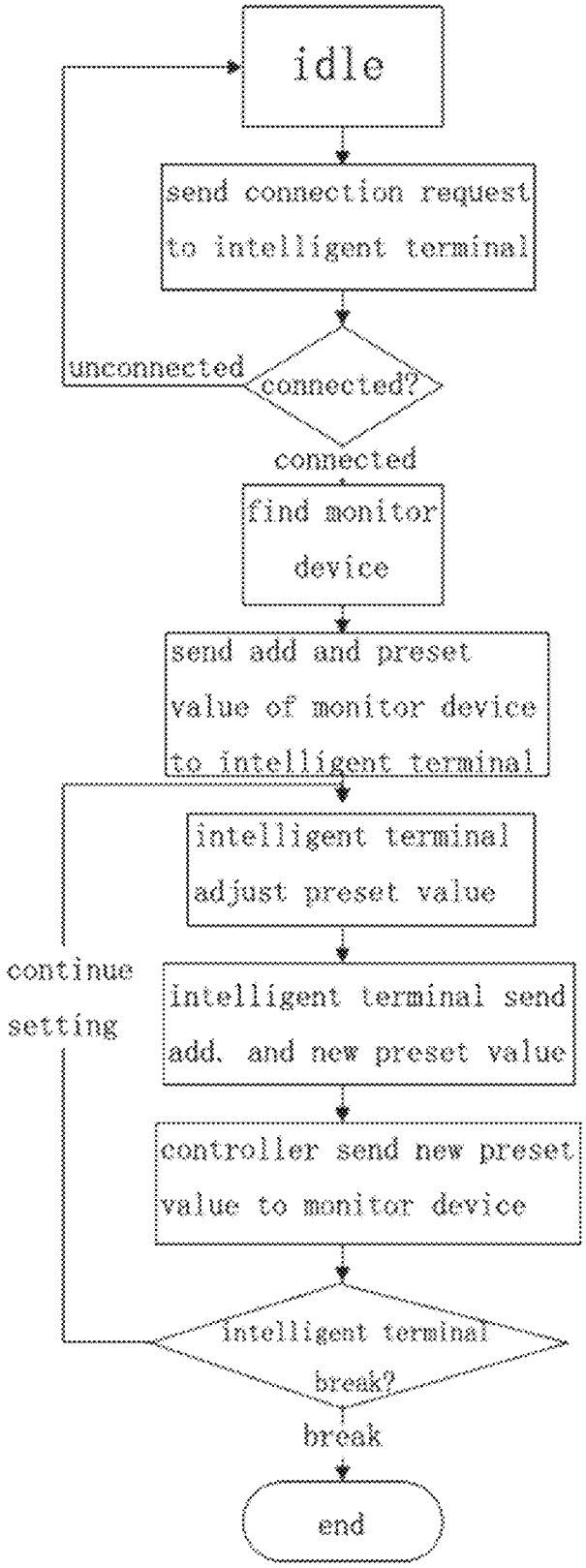
FIG. 5 is a flow chart of a configuration of an intelligent terminal to a monitor device in the present invention.

FIG. 5 is a flow chart showing the configuration of the monitor device by the intelligent terminal in the present invention, in the flow shown in the figure, the intelligent terminal configures the monitor device through the controller, as shown in the figure, when the monitor device is required to be configured by the intelligent terminal, the connection with the intelligent terminal is first determined, the specific method is as follows: the controller in an idle state issues a connection request to the intelligent terminal, the intelligent terminal determines whether the connection is performed, if not, the controller returns to the idle state, if so, the controller looks for the monitor device, and transmits the found communication address and preset value of the monitor device to the intelligent terminal, the user can adjust the preset value of the monitor device through the intelligent terminal, the intelligent terminal transmits the new preset adjusted value of the communication address of the monitor device to the controller, the controller transmits the new preset value to the corresponding monitor device according to the communication address, and then determines whether the intelligent terminal is disconnected, if not, the controller determines to the intelligent terminal whether there is a new setting, if there is the new setting, the controller continues the above transmission steps until the setting is completed and disconnected; if so, the configuration ends.

Figure 6:
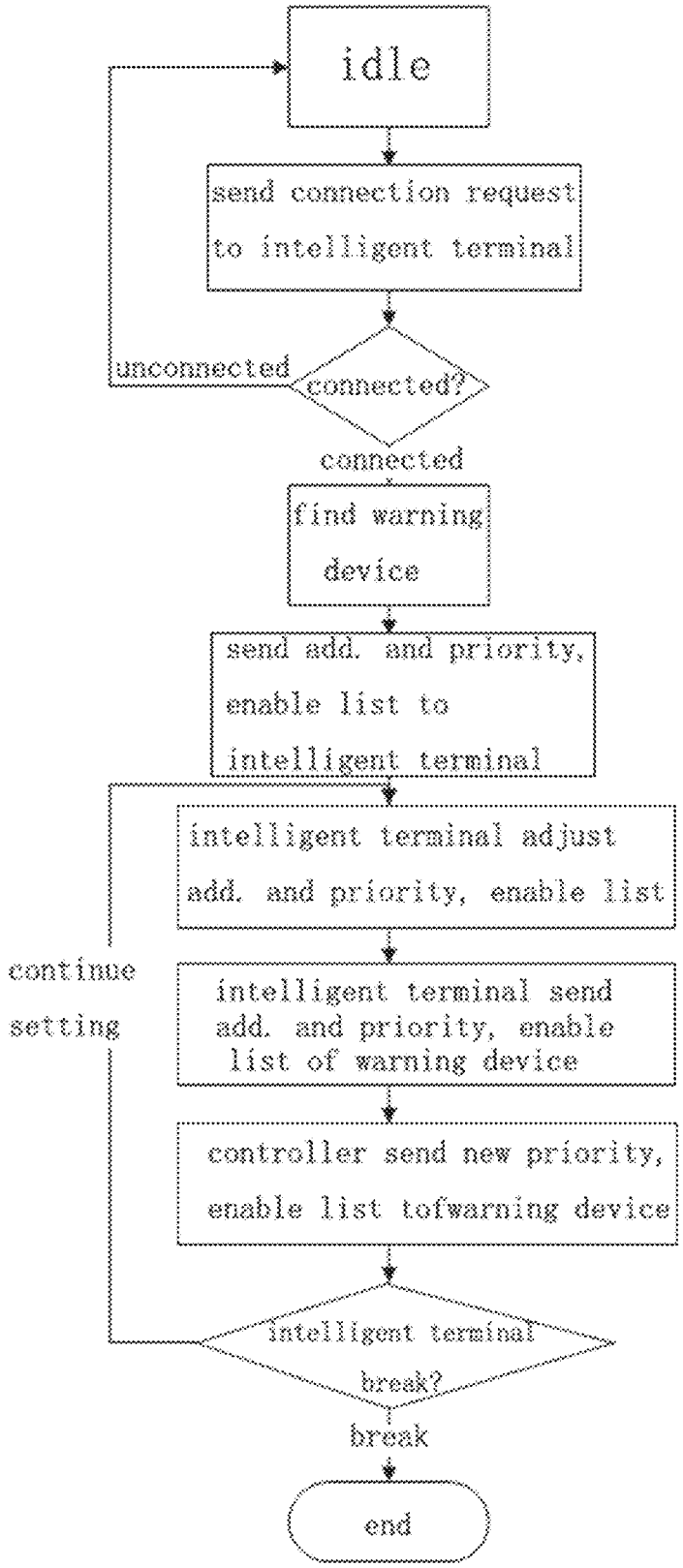
FIG. 6 is a flow chart showing the configuration of an intelligent terminal to a warning device in the present invention.

FIG. 6 is a flow chart of the configuration of the warning device by the intelligent terminal in the present invention, in the flow shown in the figure, the intelligent terminal configures the warning device through the controller, as shown in the figure, when the warning device is needed to be configured by the intelligent terminal, the connection with the intelligent terminal is first determined, the specific method is as follows: the controller in the idle state issues a connection request to the intelligent terminal, the intelligent terminal determines whether the connection is performed, if not, the controller returns to the idle state, if so, the controller looks for the warning device, and transmits the found communication address and preset priority and enabling table information of the warning device to the intelligent terminal, the user can adjust the preset priority and the enabling table information of the warning device through the intelligent terminal, and the intelligent terminal transmits to the controller the new adjusted preset priority and the enabling table information of the communication address of the warning device, the controller transmits to the corresponding warning device the new preset priority and the enabling table information according to the communication address, and then determines whether the intelligent terminal is disconnected, if not, the controller determines to the intelligent terminal whether there is the new setting, if there is the new setting, the controller continues the above-mentioned transmitting steps until the setting is completed, and then disconnects; if so, the configuration is ended.

Figure 7:
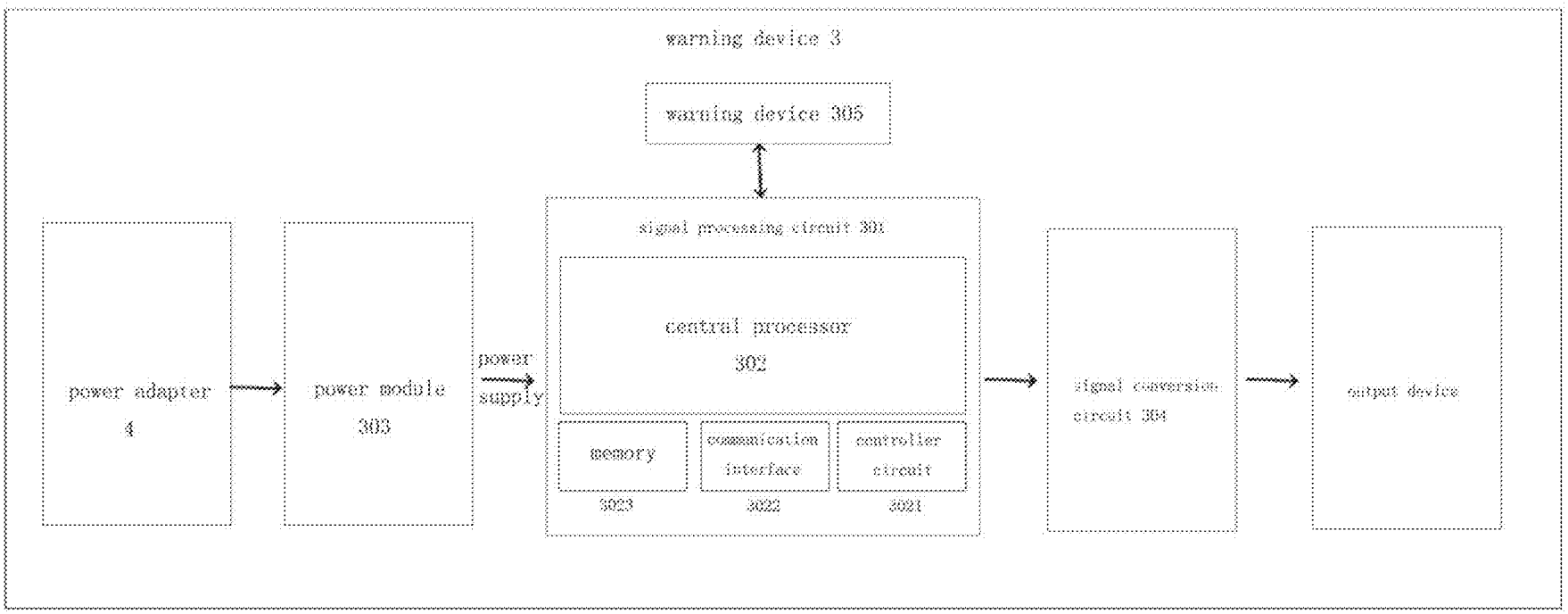
FIG. 7 is a block diagram of an internal structure of a warning device according to the present invention.

FIG. 7 is a block diagram of an internal structure of the warning device of the present invention, as shown in the figure, the warning device 3 can comprise one signal processing circuit 301, which can be used to process the warning signal received by the warning device 3, for example, the warning signal issued by the monitor device 2.

In some preferred embodiments, a signal processing circuit 301 can comprise one central processor 302 for internal processing; in some preferred embodiments, the signal processing circuit 301 can also comprise one control circuit 3021 that can be connected to the central processor 302 and receives the signal from the central processor 302 for internal control.

In some preferred embodiments, the signal processing circuit 301 can also comprise one communication interface 3022, which can be used for internal communication of the warning device 3 in some cases; in some preferred embodiments, the signal processing circuit 301 can also comprise one storage device 3023, which can be used to store the preset value in the warning device 3, such as the preset warning signal priority, warning signal information, and warning signal description.

In some preferred embodiments, the warning device 3 can comprise a power module 303 for powering the signal processing circuit 301 and the central processor 302; in some preferred embodiments, the power module 303 can also power other function modules within the warning device 3; in some preferred embodiments, the power module 303 can be externally connected to a power adapter 4; in some preferred embodiments, the power module 303 can be externally placed on the warning device 3.

In some preferred embodiments, the warning device 3 can comprise a signal conversion circuit 304 for converting a digital warning signal received by the warning system 3 into an analog signal for output; in some preferred embodiments, the warning device 3 is connected to one output device 7, the output device 7 can output the converted analog signal as the visual, audible or haptic warning signals; in some preferred embodiments, the output device 7 can be arranged in the warning device 3, in some preferred embodiments, the output device 7 can be externally connected to the warning device 3.

In some preferred embodiments, the warning device 3 can comprise a communication interface 305 for communicating with other devices, and in some preferred embodiments, the warning device 3 can be configured/preset through the communication interface 305, in some preferred embodiments, the warning device 3 can be controlled through the communication interface 305, in some preferred embodiments, the warning device 3 can transmit information to other devices, such as the cloud-connected or the intelligent terminal, through the communication interface 305.

Figure 8:
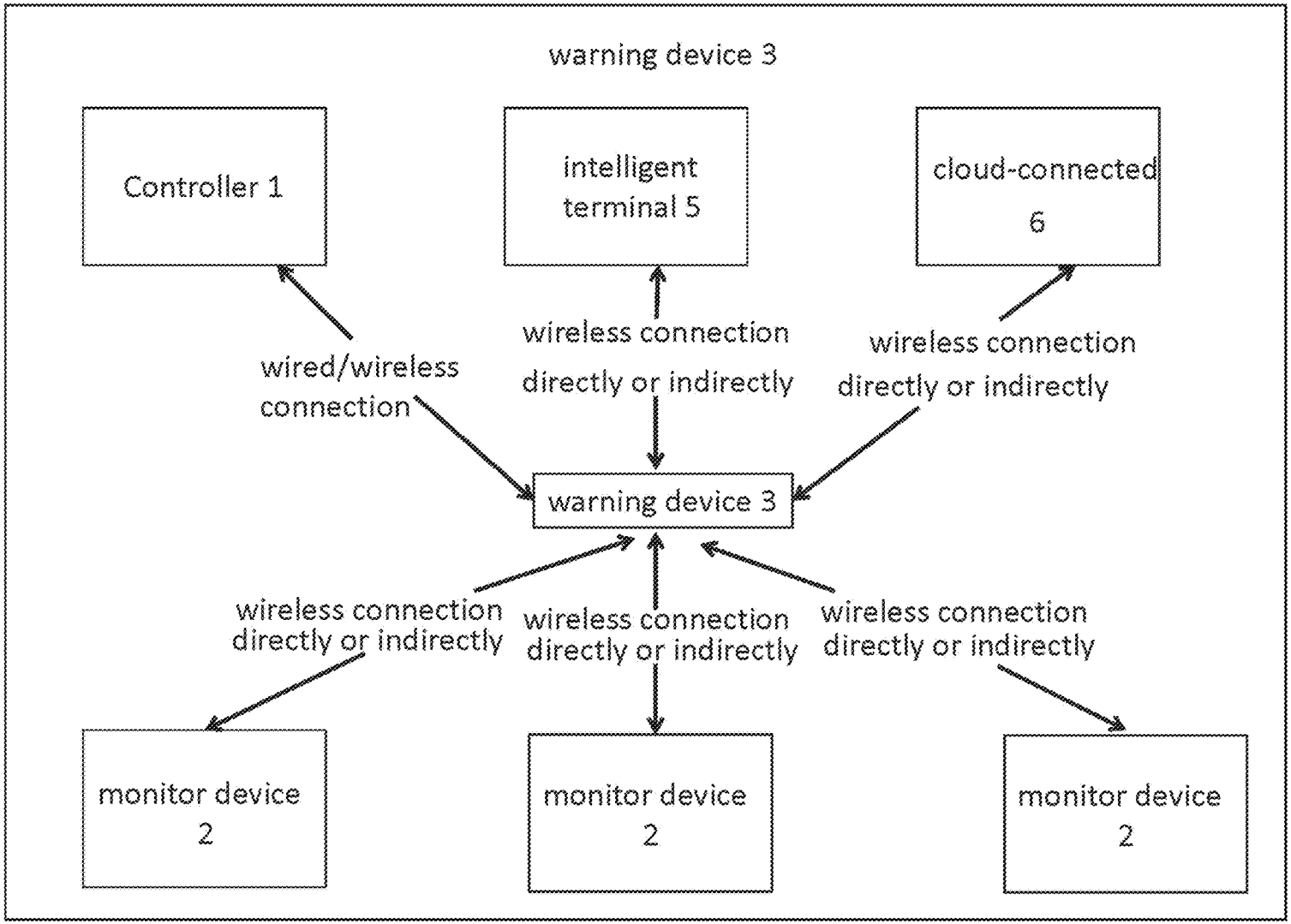
FIG. 8 is a block diagram of an external connection relationship of a warning device according to the present invention.

FIG. 8 is a block diagram of an external connection relationship of the warning device of the present invention, as shown in the figure, the warning device 3 can be directly or indirectly connected with the controller 1, the monitor device 2, the intelligent terminal 5, and the cloud-connected 6 by the wired or wireless manner, respectively and/or simultaneously; in some preferred embodiments, the monitor device 2 can be at least one, when more than one monitor device 2 is present, the connection can be established with the warning device 3, respectively.

Figure 9:
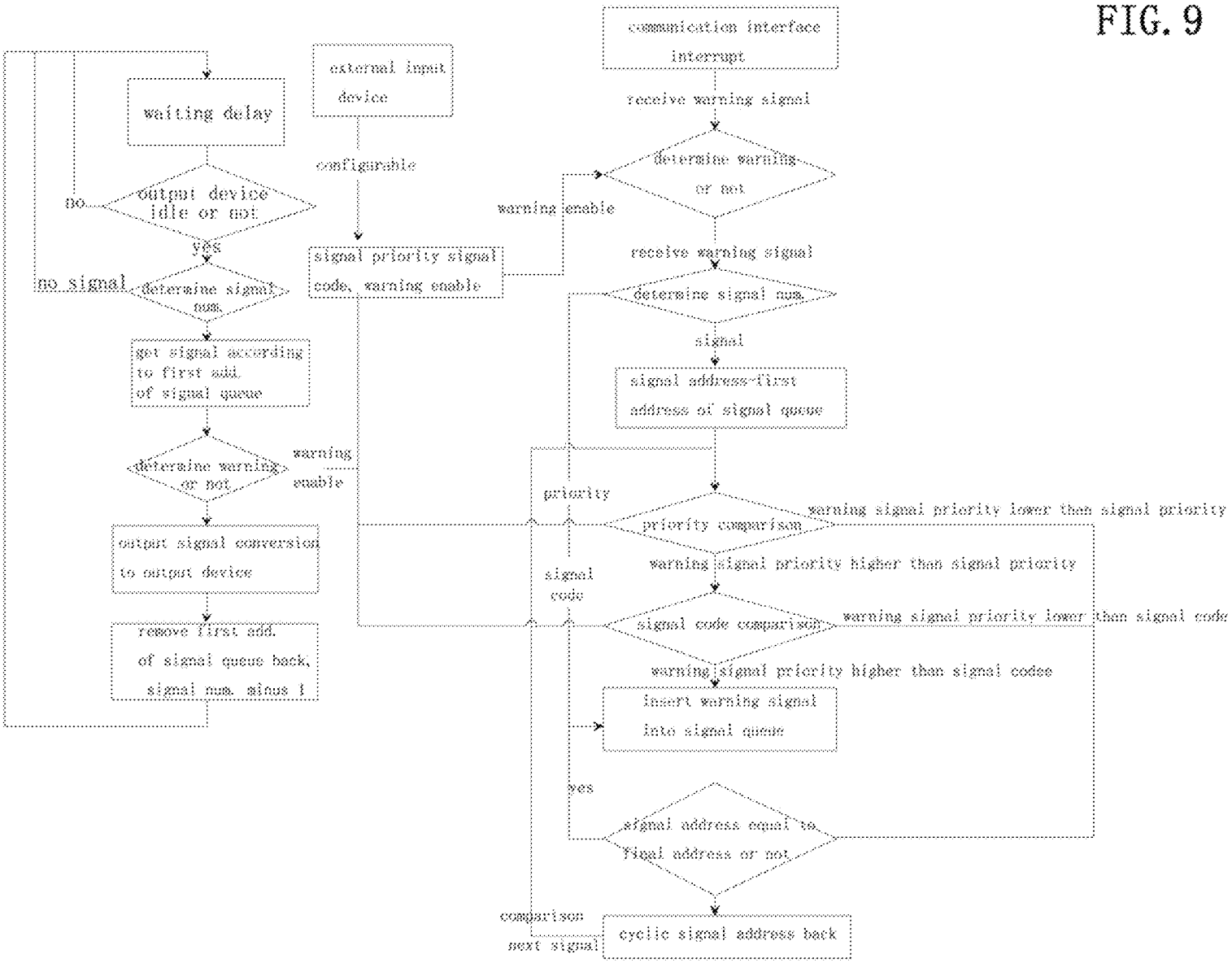
FIG. 9 is a flow chart of the processing of a warning signal according to the present invention.

FIG. 9 is a flow chart of the processing of the warning signal of the present invention, as shown in the figure, since the warning device can be preset with priority, the warning signal can be transmitted by the warning device according to the priority.

As shown in the left column of the figure, first, the warning device determines whether the output device is idle, if not, it the output device returns to wait; if so, the warning device determines the number of signals in a signal queue, if the number of signals is 0, the output device returns to wait, if there is the signal, the signal is acquired according to the address of the signal queue, and the warning device then determines whether the signal requires the warning, if so, the signal is converted and output to the output device through a signal conversion circuit, and then the first address of the signal queue is moved backward, the number of signals is decreased by 1, and then a waiting state is returned to.

As shown in the right column of the figure, when whether the signal requires warning is determined, it is necessary to comprehensively consider the preset priority and the warning enabling, as mentioned above, the warning device can configure the priority and the warning enabling thereof through other devices, when the warning signal is received, the preset priority and the warning enabling are used to determine whether the signal needs to be warned, the specific method is as follows: first, the number of signals in the signal queue is determined, if the number of signals in the queue is 0, that is, there is no signal in the queue, then the signal is inserted into the signal queue; if there is the signal, the signal address=the first address of the signal queue is defined, and the priority comparison is performed, if the priority of the current signal is lower than the signal priority in the signal address, then, it is determined whether the signal address is equal to a tail address, if not, a cyclic signal address moves backward and compares the next signal; if the priority of the current signal is higher than the signal priority in the signal address, the signal code is compared, if the signal code of the current signal is lower than the signal code in the signal address, then it is determined whether the signal address is equal to the tail address, if not, the cyclic signal address is moved backward, and the next signal is compared; if the signal code of the current signal is higher than the signal code of the signal address, the current signal is inserted into the signal queue to perform conversion and output.

Figure 10:
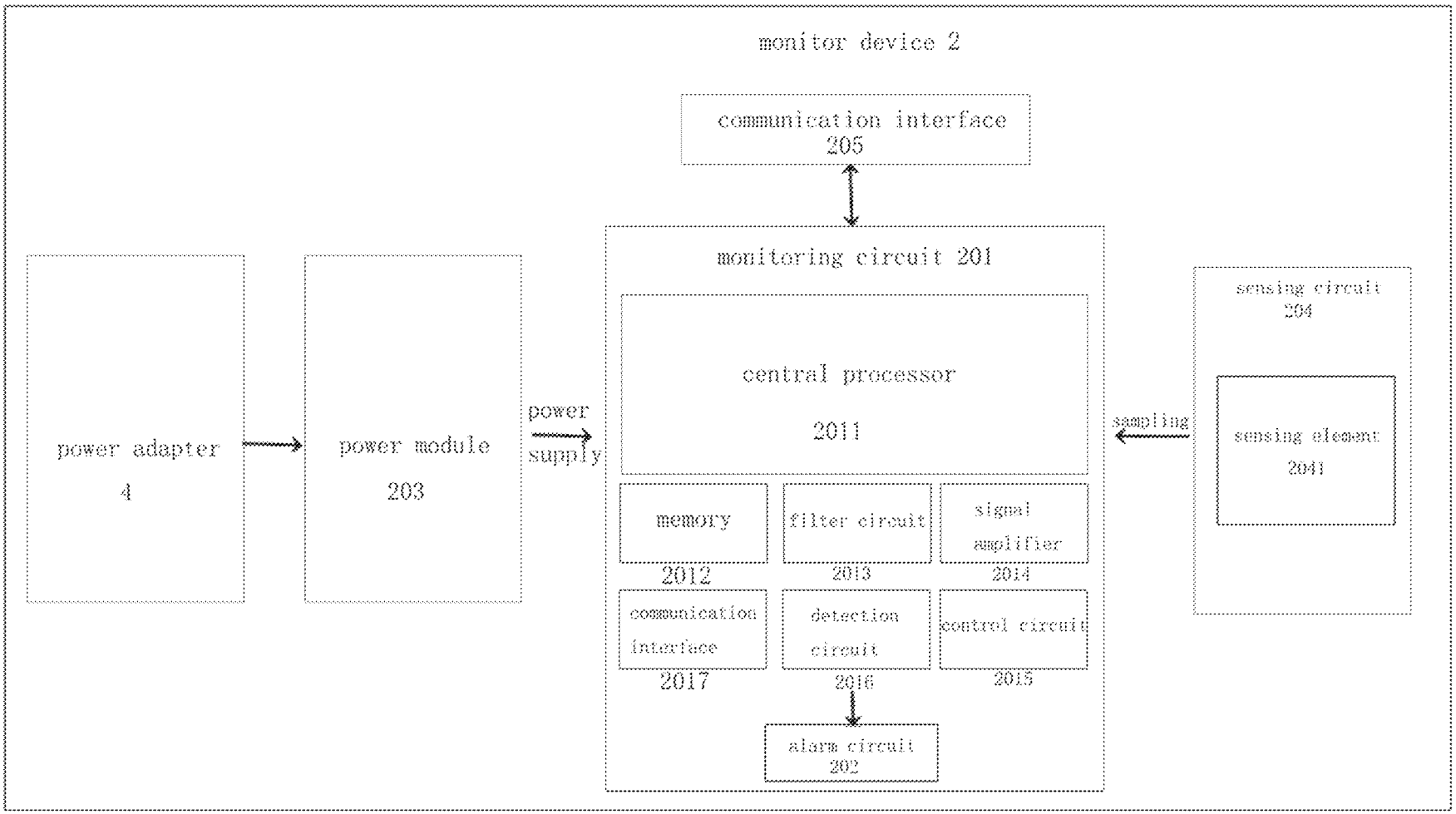
FIG. 10 is a block diagram of an internal structure of a monitor device according to the present invention.

FIG. 10 is a structural diagram of the monitor device of the present invention, as shown in the figure, the monitor device 2 comprises a monitoring circuit 201, which can be used to receive a sampled value and perform calculation on the sampled value to determine that the monitored object is in the normal state, the abnormal state, the stable state, or the unstable state.

Figure 20:
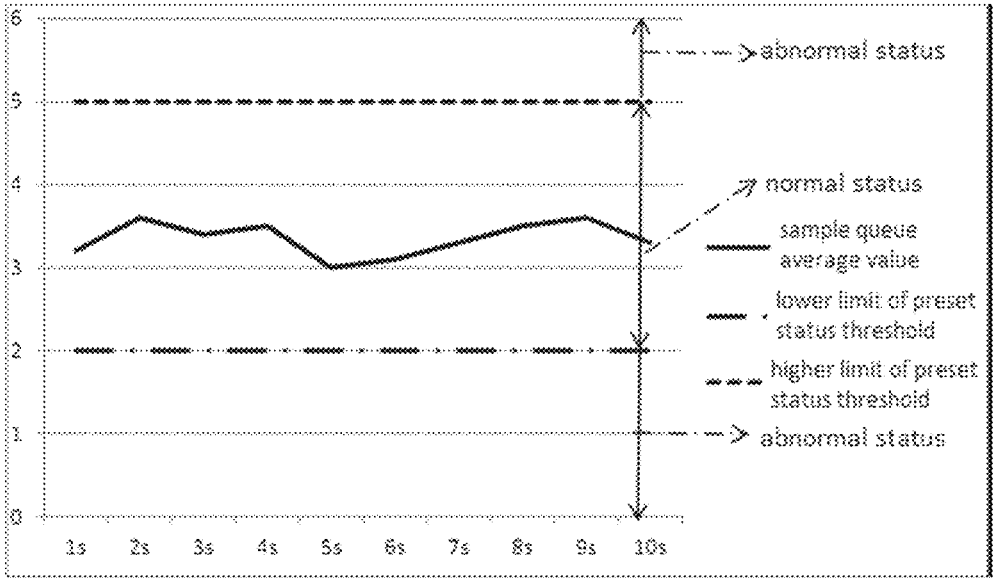
FIG. 20 is a diagram of the determination by a monitoring circuit to a normal state and an abnormal state according to the present invention.

In some preferred embodiments, the monitoring circuit 201 can comprise a central processor 2011 that can be used to process a sampled signal input to the monitor device 2; in some preferred embodiments, the monitoring circuit 201 can comprise a storage device 2012 that can be used to store the preset value of the monitor device; in some preferred embodiments, the monitoring circuit 201 can also comprise one control circuit 2015 that can be connected to the central processor 2011 and receive a signal from the central processor 2011 for internal control. In some preferred embodiments, the monitoring circuit 201 can also comprise one communication interface 2017, which can be used for internal communication of the monitor device 2 in some cases; in some preferred embodiments, the monitoring circuit 201 can also comprise a filter circuit 2013, a signal amplifier 2014 and the detection circuit 2016, the detection circuit 2016 can be used to detect the stability and integrity of the sampled data. As a sample, FIG. 20 shows a sample of diagram of the determination by a monitoring circuit to a normal state and an abnormal state according to the present invention.

In some preferred embodiments, the monitor device 2 can comprise a power module 203 for powering the monitoring circuit 201 and the central processor 2011; in some preferred embodiments, the power module 203 can also power other functional modules in the monitor device 2; in some preferred embodiments, the power module 203 can be externally connected to the power adapter 4; in some preferred embodiments, the power module 203 can be externally placed on the monitor device 2.

In some preferred embodiments, the monitor device 2 can comprise the induction circuit 204 that can be used to directly and indirectly be connected and/or attached to the merchandise and/or the merchandise anti-theft device for sensing information and sampling through the induction method, alternatively, the induction circuit 204 can sample an environment; in some preferred embodiments, the induction circuit 204 performs sampling through the induction element 2041, the induction element 2041 can be various sensors, such as a temperature sensor, a voltage sensor, a current sensor, a humidity sensor, a vibration sensor, a pressure sensor, a magnetic field sensor, an infrared sensor, a light sensor, etc.

In some preferred embodiments, the monitor device 2 can comprise a communication interface 205 for communicating with other devices, in some preferred embodiments, the monitor device 2 can be configured/preset through the communication interface 205, in some preferred embodiments, the monitor device 2 can be controlled through the communication interface 205, in some preferred embodiments, the monitor device 2 can transmit information to other devices, such as the cloud-connected 6 or the intelligent terminal 5, through the communication interface 205.

In some preferred embodiments, the monitor device 2 can be connected to an alarm circuit 202, in some preferred embodiments, the monitor device 2 can directly warning through the alarm circuit 202; in some preferred embodiments, the monitor device 2 can transmit a warning signal outward through the alarm circuit 202

Figure 11:
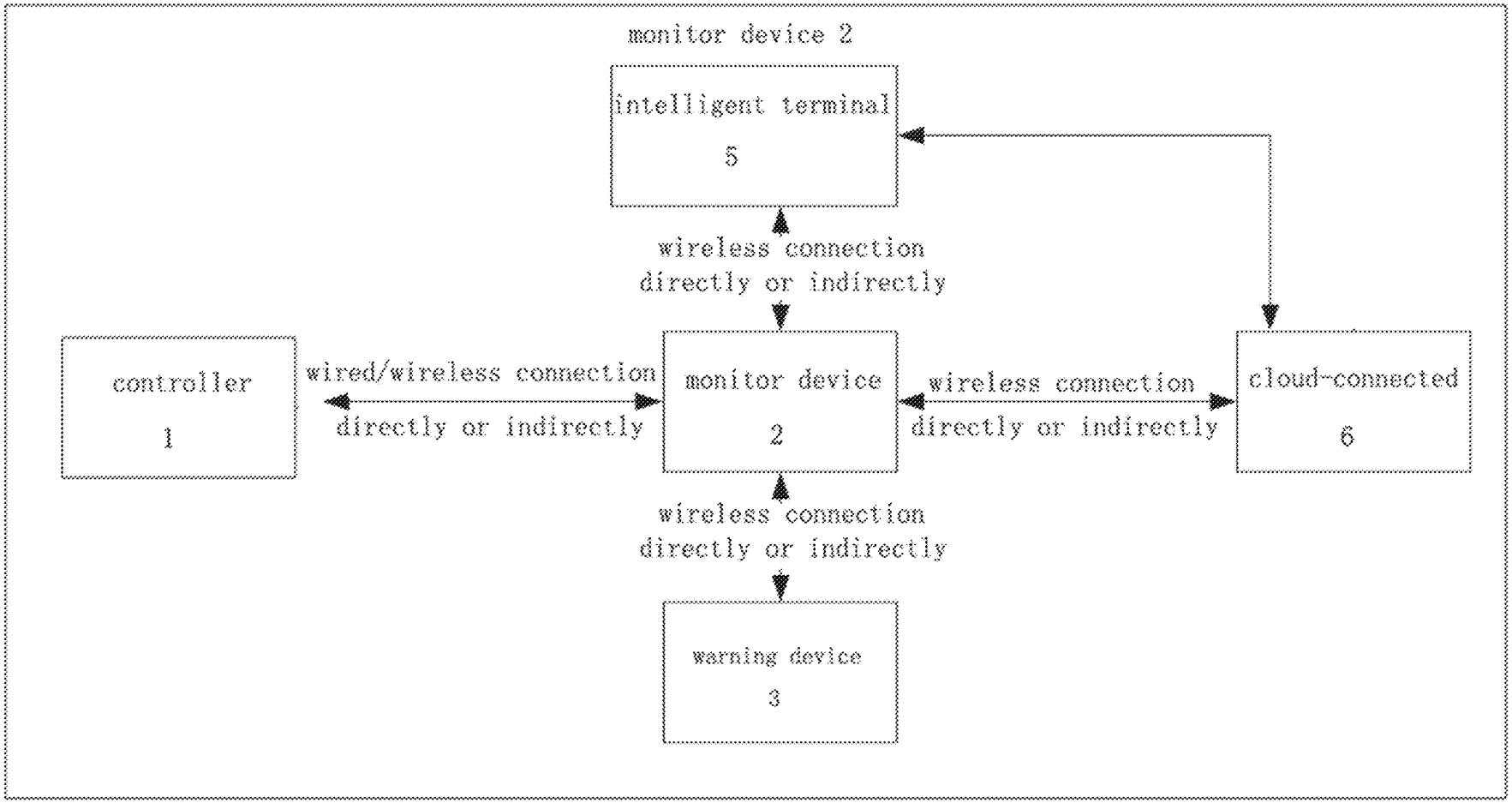
FIG. 11 is a block diagram of an external connection relationship of a monitor device according to the present invention.

FIG. 11 is a block diagram of an external connection relationship of the monitor device of the present invention, as shown in the figure, the monitor device 2 be directly or indirectly connected with the controller 1, the warning device 3, the intelligent terminal 5, and the cloud-connected 6 the wired or wireless manner, respectively and/or simultaneously; in some preferred embodiments, the connection between the cloud-connected 6 and the intelligent terminal 5 can also be established independently.

Figure 12:
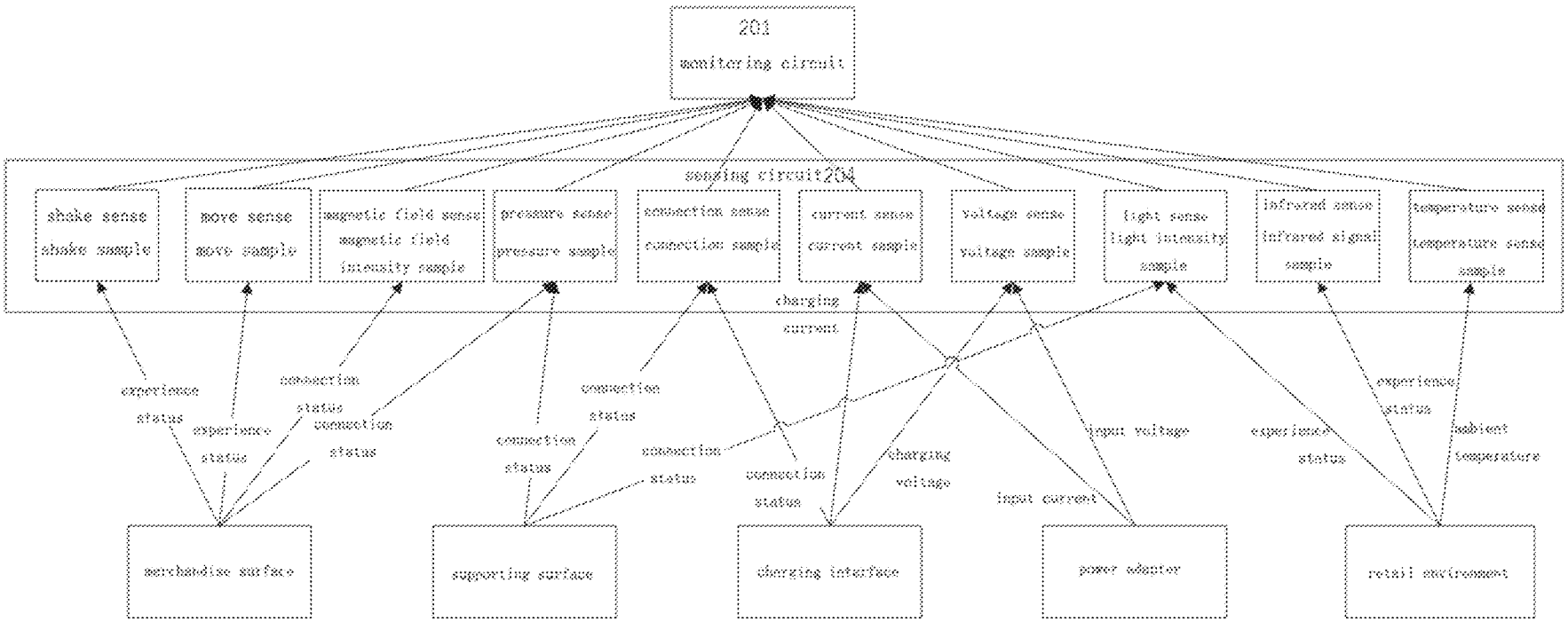
FIG. 12 is a diagram of the monitoring and induction of a monitor device according to the present invention.

FIG. 12 is a diagram of the monitoring and induction of the monitor device of the present invention, as shown in the figure, the induction circuit can comprise various induction sampling elements/circuits, for example, a vibration induction element is used for vibration sampling, and a movement induction element is used for sampling movement, a magnetic field induction element is used for sampling a magnetic field strength, a pressure induction element is used for sampling a pressure value, a connecting induction element is used for sampling a connection state, a current induction element is used for sampling the current value, and a voltage induction element is for sampling a voltage value, a light induction element samples light intensity, the infrared induction element samples an infrared signal, and the temperature induction element samples an ambient temperature or a temperature of an attached article.

In some preferred embodiments, the vibration induction element, the movement induction element or the magnetic field induction element or the pressure induction element can be used to sample the surface of the merchandise; in some preferred embodiments, the pressure induction element, the connection induction element or the light induction element can be used to sample a support surface; in some preferred embodiments, the connection induction element, the current induction element or the voltage induction element can be used to sample a charging interface; in some preferred embodiments, the current induction element or the voltage induction element can be used to sample the power adapter; in some preferred embodiments, the light induction element, the infrared induction element or the temperature induction element can be used to sample a retail environment or the environment in which the merchandise is located.

In some preferred embodiments, the magnetic field induction element, the pressure induction element, the connection induction element or the light induction element can inductively sample the connection state; in some preferred embodiments, the vibration induction element, the movement induction element, the light induction element or the infrared induction element can inductively sample the experience state of the merchandise, such as whether the merchandise is in an experienced state, the number of times that the merchandise is experienced, and the length of time experienced; in some preferred embodiments, the current induction element can inductively sample a charging current of the charging interface and an input current of the power adapter; in some preferred embodiments, the voltage induction element can inductively sample a charging voltage of the charging interface and an input voltage of the power adapter; in some preferred embodiments, the temperature induction element can be used to inductively sample the temperature of the environment.

FIG. 13 is a flow diagram of processing of the monitor device of the present invention, as shown in the figure, The calculation and determination processes of the sampling value by the monitor device 2 are as follows:

First, the sampled value of the induction circuit is acquired in real time, and the sampled value queues X1, X2, X3, Xn (n>=32) are formed in units of the minimum sampled number 32.

A. the determination of the normal state and the abnormal state:

For the sampled value queues X1, X2, X3, Xn, the arithmetic average value is calculated according to formula (1).

formula (1)

$$\tilde{x} = \frac{x_1 + x_2 + \ldots + x_n}{n} = \frac{\sum_{i=1}^{n} x_i}{n}$$

the sampled queue average is obtained.

The monitor device can initialize the peripherals to set a preset state, that is, the normal state, upper and lower thresholds of the preset state threshold are set, after the arithmetic average operation is performed for the sampling queue, the average value of the sampling queue is obtained, and compared with the preset state threshold:

>the upper limit of the preset state threshold—an abnormality occurs, and the monitor device runs to the abnormal state;

<the lower limit of the preset state threshold—an abnormality occurs, and the monitor device runs to the abnormal state;

The lower limit of the preset state threshold<the average value of the sampling queue<the upper limit of the preset state threshold—a normality occurs, and the monitor device runs to the normal state.

B. The determination of the stable state and the unstable state:

For the sampled value queues X1, X2, X3, Xn, according to formulas (2)-(4), the arithmetic average value $\bar{x}$, variance σ2, standard deviation σ are calculated, formula (2)

$$\tilde{x} = \frac{x_1 + x_2 + \ldots + x_n}{n} = \frac{\sum_{i=1}^{n} x_i}{n},$$

formula (3)

$$\sigma^2 = \frac{\sum_{i=1}^{N} (x_i - \mu)^2}{N},$$

formula (4)

$$\sigma = \sqrt{\sigma^2} = \sqrt{\frac{\sum_{i=1}^{N} (x_i - \mu)^2}{N}},$$

Figure 21:
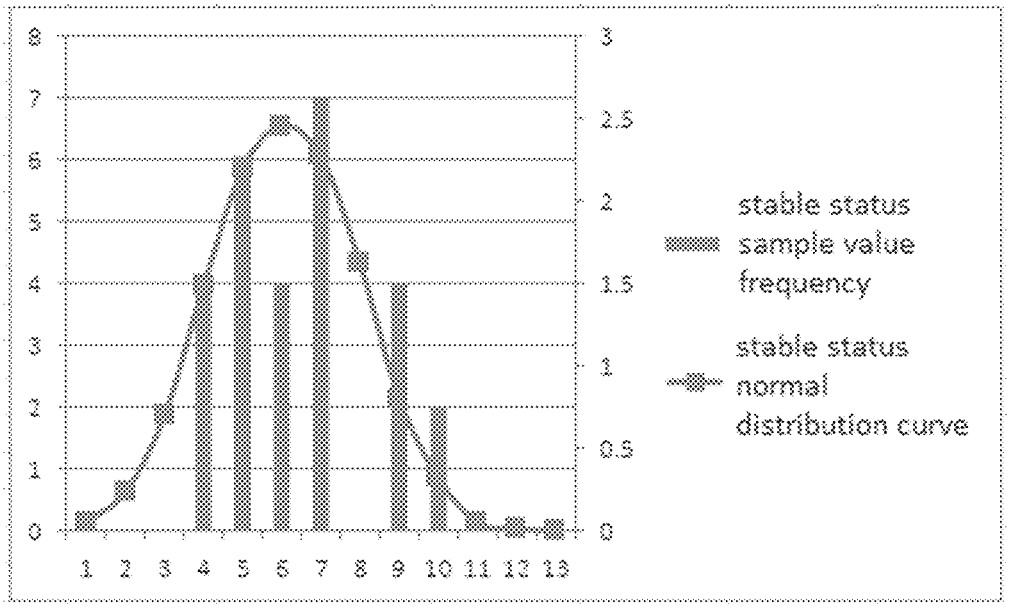
FIG. 21 is a curve of a frequency and a normal distribution of a sampled value of a stable state according to the present invention.
Figure 22:
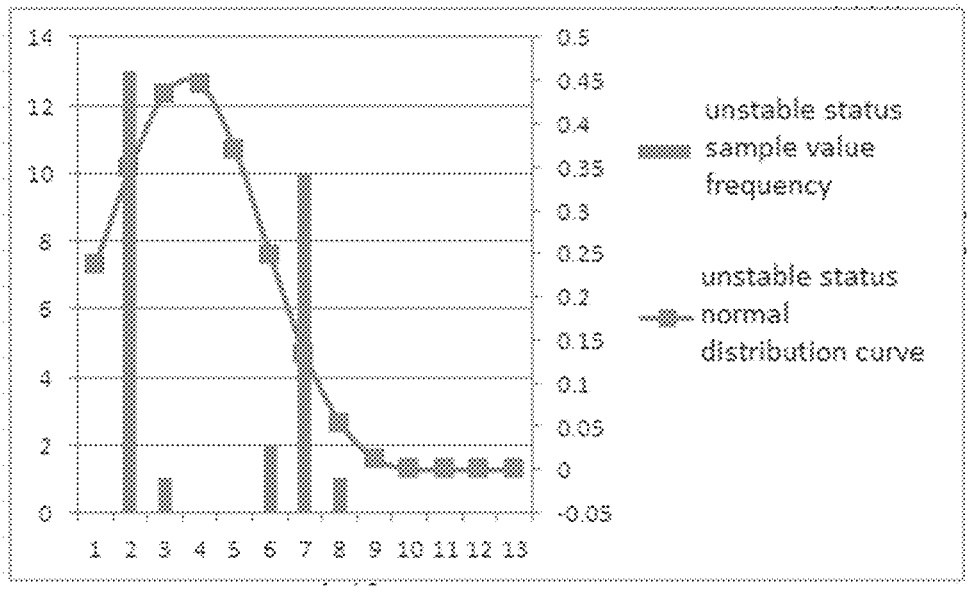
FIG. 22 is a diagram of a frequency and a normal distribution curve of the sampled values of the unstable state according to the present invention.
Figure 23:
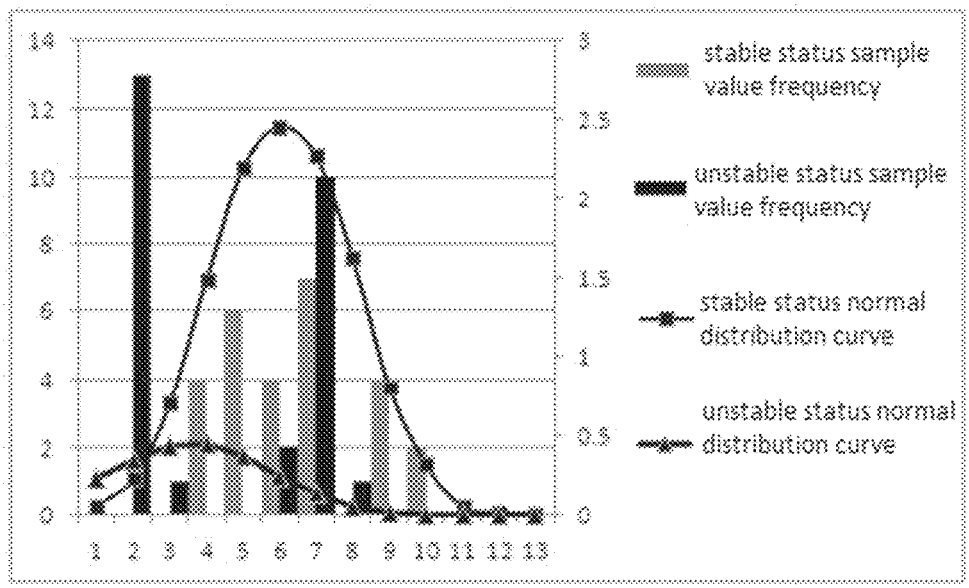
FIG. 23 is a comparison of a frequency and a normal distribution curve of sampled values of a stable state and an unstable state according to the present invention.

The arithmetic average value $\bar{x}$, the variance σ2, and the standard deviation σ of the sampling queue are obtained, and the normal distribution curve shown in FIGS. 21-23 is drawn.

The monitor device can initialize the peripheral device to set a stable state threshold, comprising: calculating an arithmetic mean threshold μ, a normal distribution deviation degree threshold interval [μ−5δ, μ+5δ]. Through the data analysis and processing of the sampling queue, the arithmetic mean μ1 and the interval of normal distribution probability density maximum values [A1, A2] are obtained and are compared with the stable state threshold:

When [A1, A2]⊆[μ−5δ, μ+5δ] and |μ−μ1|≤3δ, the sampled induction circuit is in the stable state.

When A2<μ−5δ or |μ−μ1|>3δ, the sampled induction circuit is in the unstable state.

When A1>μ+5δ or |μ−μ1|>3δ, the sampled induction circuit is in the unstable state.

What is claimed is:

1. A warning system for merchandise security, comprising a monitor device, a warning device and a controller;

the monitor device is capable of directly or indirectly connected to a merchandise, a merchandise display device or a combination of the merchandise and the merchandise display device, and is configured to be capable of monitoring a connection state of the merchandise, the merchandise display device or a combination of the merchandise and the merchandise display device, and issuing a warning signal when the connection state is in an abnormal state, an unstable state or a combination of the abnormal state and the unstable state;

the warning device is configured to be capable of receiving the warning signal issued by the monitor device and outputting the warning signal through an output device;

the controller comprises an identifiable communication interface and is configured to enable the warning signal of the monitor device and the warning device to be released through a communication interface;

wherein the controller releases the warning signal by grading: when a controller button is touched for a short time, the controller releases the warning signal; when the controller button is touched for a long time, the controller releases the warning signal and changes a preset state of the monitor device.

2. The warning system for the merchandise security according to claim 1, wherein the monitor device comprises an induction circuit, and is configured to enable the merchandise, the merchandise display device or a combination of the merchandise and the merchandise display device to be sampled, or to be capable of sensing the connection state of the merchandise, merchandise display device or a combination of the merchandise and the merchandise display device;

the induction circuit is configured to be capable of feeding back a sampling result to a monitoring circuit.

3. The warning system for the merchandise security according to claim 1, wherein the monitor device comprises an alarm circuit, and is configured to receive the warning signal of the monitoring circuit and transmit the warning signal to the warning device.

4. The warning system for the merchandise security according to claim 2, wherein the warning device comprises a signal processing circuit, and is configured to be capable of receiving and processing the warning signal of the monitoring circuit and outputting the processed signal through the output device;

the warning signal comprises the warning signal for warning the abnormal state and the warning signal for warning the unstable state.

5. The warning system for the merchandise security according to claim 1, wherein the controller is configured to be capable of initializing the monitor device and the warning device through the identifiable communication interface.

6. The warning system for the merchandise security according to claim 5, wherein the controller configures the preset state and a preset value of the monitor device and a preset state and a preset value of the warning device by initialization.

7. The warning system for the merchandise security according to claim 5, wherein the initialization comprises the initialization of a controlling relationship; the initialization of the controlling relationship indicates that the initialized monitor device, the warning device or a combination of the initialized monitor device and the warning device are capable of identifying and executing a control signal issued by the controller.

8. The warning system for the merchandise security according to claim 5, wherein the initialization comprises the initialization of a warning relationship; the initialization of the warning relationship indicates that the initialized warning device is capable of identifying and executing the warning signal issued by the initialized monitor device.

9. The warning system for the merchandise security according to claim 5, wherein the initialization further comprises the initialization of a warning mode.

10. The warning system for the merchandise security according to claim 9, wherein the initialization of the warning mode comprises a preset warning signal priority, and the warning device configured by a preset mode is capable of sequentially outputting the warning signal according to the preset warning signal priority.

11. The warning system for the merchandise security according to claim 9, wherein the initialization of the warning mode comprises a preset warning signal output function, and the warning device configured by a preset mode is capable of selectively outputting different type of warning signals according to the preset signal output function.

12. The warning system for the merchandise security according to claim 1, wherein the warning signal comprises a visual signal, an audible signal, a haptic signal or any combination of the visual signal, the audible signal and the haptic signal.

13. The warning system for the merchandise security according to claim 1, wherein the warning signal comprises an alarm signal, an alerting signal, a prompt signal or any combination of the alarm signal, the alerting signal and the prompt signal.

14. The warning system for the merchandise security according to claim 6, wherein the preset state is changeable according to a state of the monitor device; and the monitor device controls determination of the abnormal state through a preset threshold, controls determination of an abnormal logic of the warning system through the preset state, and controls the abnormal logic through a preset state threshold and the preset state.

* * * * *